US009648440B2

(12) United States Patent
Crockett et al.

(10) Patent No.: US 9,648,440 B2
(45) Date of Patent: May 9, 2017

(54) VIRTUAL HEIGHT FILTER FOR REFLECTED SOUND RENDERING USING UPWARD FIRING DRIVERS

(71) Applicant: DOLBY LABORATORIES LICENSING CORPORATION, San Francisco, CA (US)

(72) Inventors: Brett G. Crockett, Brisbane, CA (US); Christophe Chabanne, Carpentras (FR); Mark Tuffy, Sonoma, CA (US); Alan J. Seefeldt, San Francisco, CA (US); C. Phillip Brown, Castro Valley, CA (US); Patrick Turnmire, Arroyo Seco, NM (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 8 days.

(21) Appl. No.: 14/759,182

(22) PCT Filed: Jan. 7, 2014

(86) PCT No.: PCT/US2014/010466

§ 371 (c)(1),
(2) Date: Jul. 2, 2015

(87) PCT Pub. No.: WO2014/107714

PCT Pub. Date: Jul. 10, 2014

(65) Prior Publication Data

US 2015/0304791 A1 Oct. 22, 2015

Related U.S. Application Data

(60) Provisional application No. 61/749,789, filed on Jan. 7, 2013, provisional application No. 61/835,466, filed (Continued)

(51) Int. Cl.
*H04R 5/02* (2006.01)
*H04S 7/00* (2006.01)

(Continued)

(52) U.S. Cl.
CPC ..... *H04S 7/307* (2013.01); *H04R 1/02* (2013.01); *H04R 1/26* (2013.01); *H04R 3/04* (2013.01);

(Continued)

(58) Field of Classification Search
CPC ..... H04R 3/005; H04R 3/12; H04R 2499/11; H04R 2203/12; H04R 2201/40;

(Continued)

(56) References Cited

U.S. PATENT DOCUMENTS 4,051,919 A 10/1977 Buettner
4,410,063 A 10/1983 Yasue (Continued)

FOREIGN PATENT DOCUMENTS

DE 2941692 4/1981
DE 3201455 7/1983

(Continued)

OTHER PUBLICATIONS

Stanojevic, T. et al "The Total Surround Sound System", 86th AES Convention, Hamburg, Mar. 7-10, 1989.

(Continued)

*Primary Examiner* — Akelaw Teshale

(57) ABSTRACT

Embodiments are directed to speakers and circuits that reflect sound off a ceiling to a listening location at a distance from a speaker. The reflected sound provides height cues to reproduce audio objects that have overhead audio components. The speaker comprises upward firing drivers to reflect sound off of the upper surface and represents a virtual height speaker. A virtual height filter based on a directional hearing (Continued)

model is applied to the upward-firing driver signal to improve the perception of height for audio signals transmitted by the virtual height speaker to provide optimum reproduction of the overhead reflected sound. The virtual height filter may be incorporated as part of a crossover circuit that separates the full band and sends high frequency sound to the upward-firing driver.

20 Claims, 15 Drawing Sheets

Related U.S. Application Data on Jun. 14, 2013, provisional application No. 61/914,854, filed on Dec. 11, 2013.

(51) Int. Cl.

| | |
|---|---|
| ***H04R 1/26*** | (2006.01) |
| ***H04R 3/12*** | (2006.01) |
| ***H04R 3/14*** | (2006.01) |
| ***H04R 1/02*** | (2006.01) |
| ***H04R 3/04*** | (2006.01) |

(52) U.S. Cl.

CPC ..... *H04R 3/12* (2013.01); *H04R 3/14* (2013.01); *H04R 5/02* (2013.01); *H04R 2205/024* (2013.01)

(58) Field of Classification Search

CPC ..... H04R 2410/01; H04R 2430/25; H04R 2499/15; H04R 2430/20; H04R 1/323; H04R 2201/405; H04R 2460/01; H04R 1/403; H04R 1/406; H04R 29/005; H04R 29/008

USPC ..... 38/17, 18, 27, 307, 80, 92, 97, 1, 182, 38/19, 2, 22, 300, 56, 61, 71.6, 77, 98, 38/160, 386, 186, 336, 99, 335, 387, 303, 38/350, 152, 30, 7, 342, 345, 348, 104, 38/120, 301, 304, 306, 332, 333, 337, 38/338, 340, 349, 351, 361, 388, 412, 38/432, 433, 55, 57, 71.7, 89, 94.5

See application file for complete search history.

(56) References Cited

U.S. PATENT DOCUMENTS

| | | | | |
|---|---|---|---|---|
| 6,257,365 | B1 * | 7/2001 | Hulsebus, II | H04R 1/34 181/155 |
| 2006/0098827 | A1 | 5/2006 | Paddock | |
| 2007/0263888 | A1 | 11/2007 | Melanson | |
| 2011/0064258 | A1 | 3/2011 | Aggarwal | |
| 2011/0216925 | A1 | 9/2011 | Riggs | |
| 2012/0014544 | A1 * | 1/2012 | Gladwin | H04R 3/12 381/304 |
| 2012/0140936 | A1 | 6/2012 | Bonnick | |
| 2013/0121516 | A1 * | 5/2013 | Lamb | H04S 7/302 381/307 |
| 2014/0133683 | A1 | 5/2014 | Robinson | |
| 2015/0223002 | A1 * | 8/2015 | Mehta | H04S 7/30 381/303 |

FOREIGN PATENT DOCUMENTS

| | | |
|---|---|---|
| JP | S50-086333 | 7/1975 |
| JP | S58-043697 | 3/1983 |
| JP | H05-219597 | 8/1993 |
| JP | H10-69280 | 3/1998 |
| JP | 2004-349793 | 12/2004 |
| JP | 2010-258497 | 11/2010 |
| JP | 2010-258653 | 11/2010 |
| JP | 2012-529215 | 11/2012 |
| RS | 1332 U | 8/2013 |
| RU | 2364053 | 8/2009 |
| WO | 01/67808 | 9/2001 |
| WO | 2009/101778 | 8/2009 |
| WO | 2011/045751 | 4/2011 |
| WO | 2013/002401 | 1/2013 |

OTHER PUBLICATIONS

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner $$H(z) = \frac{0.9911 - 1.3044z^{-1} + 1.3382z^{-2} - 0.8314z^{-3} + 0.3840z^{-4}}{1.000 - 1.3143z^{-1} + 1.2533z^{-2} - 0.6224z^{-3} + 0.2656z^{-4}}$$

VIRTUAL HEIGHT FILTER FOR REFLECTED SOUND RENDERING USING UPWARD FIRING DRIVERS

CROSS-REFERENCE TO RELATED APPLICATIONS

This application claims priority to U.S. Provisional Patent Application No. 61/749,789, filed on 7 Jan. 2013, U.S. Provisional Patent Application No. 61/835,466, filed on 14 Jun. 2013 and U.S. Provisional Patent Application No. 61/914,854, filed on 11 Dec. 2013, each of which is hereby incorporated by reference in its entirety.

FIELD OF THE INVENTION

One or more implementations relate generally to audio signal processing, and more specifically to speakers and circuits for rendering adaptive audio content using reflected signals generated by upward firing speakers.

BACKGROUND

The advent of digital cinema has created new standards for cinema sound, such as the incorporation of multiple channels of audio to allow for greater creativity for content creators and a more enveloping and realistic auditory experience for audiences. Model-based audio descriptions have been developed to extend beyond traditional speaker feeds and channel-based audio as a means for distributing spatial audio content and rendering in different playback configurations. The playback of sound in true three-dimensional (3D) or virtual 3D environments has become an area of increased research and development. The spatial presentation of sound utilizes audio objects, which are audio signals with associated parametric source descriptions of apparent source position (e.g., 3D coordinates), apparent source width, and other parameters. Object-based audio may be used for many multimedia applications, such as digital movies, video games, simulators, and is of particular importance in a home environment where the number of speakers and their placement is generally limited or constrained by the confines of a relatively small listening environment.

Various technologies have been developed to more accurately capture and reproduce the creator's artistic intent for a sound track in both full cinema environments and smaller scale home environments. A next generation spatial audio (also referred to as "adaptive audio") format has been developed that comprises a mix of audio objects and traditional channel-based speaker feeds along with positional metadata for the audio objects. In a spatial audio decoder, the channels are sent directly to their associated speakers or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer utilizes certain algorithms to distribute the audio associated with each object across the attached set of speakers. The authored spatial intent of each object is thus optimally presented over the specific speaker configuration that is present in the listening environment.

Current spatial audio systems have generally been developed for cinema use, and thus involve deployment in large rooms and the use of relatively expensive equipment, including arrays of multiple speakers distributed around a theater. An increasing amount of advanced audio content, however, is being made available for playback in the home environment through streaming technology and advanced media technology, such as Blu-ray disks, and so on. In addition, emerging technologies such as 3D television and advanced computer games and simulators are encouraging the use of relatively sophisticated equipment, such as large-screen monitors, surround-sound receivers and speaker arrays in home and other listening environments. In spite of the availability of such content, equipment cost, installation complexity, and room size remain realistic constraints that prevent the full exploitation of spatial audio in most home environments. For example, advanced object-based audio systems typically employ overhead or height speakers to playback sound that is intended to originate above a listener's head. In many cases, and especially in the home environment, such height speakers may not be available. In this case, the height information is lost if such sound objects are played only through floor or wall-mounted speakers.

What is needed, therefore, is a system that allows full spatial information of an adaptive audio system to be reproduced in a listening environment that may include only a portion of the full speaker array intended for playback, such as limited or no overhead speakers, and that can utilize upward directed speakers to reflect sound to places where direct speakers may not exist.

What is further needed is a filtering method that applies a desired frequency transfer function to reduce or eliminate direct sound components from height sound components in audio signals intended to be reflected off of upper surfaces of a listening environment.

What is further needed is a speaker system that incorporates the desired frequency transfer function directly into the transducer design of the speakers configured to reflect sound off of the upper surfaces.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to speakers and circuits that reflect sound off a ceiling or upper surface to a listening location at a distance from a speaker. The reflected sound provides height cues to reproduce audio objects that have overhead audio components. The speaker comprises one or more upward firing drivers to reflect sound off of the upper surface and represents a virtual height speaker. A virtual height filter based on a directional hearing model is applied to the upward-firing driver signal to improve the perception of height for audio signals transmitted by the virtual height speaker to provide optimum reproduction of the overhead reflected sound. Additionally, the virtual height filter may be incorporated as part of a crossover circuit that separates the full band and sends high frequency sound to the upward-firing driver. Room correction processes are also used to provide calibration and maintain virtual height filtering in systems that perform automatic room equalization and other anomaly negating processes.

Such speakers and circuits are configured to be used in conjunction with an adaptive audio system for rendering sound using reflected sound elements comprising an array of audio drivers for distribution around a listening environment, where some of the drivers are direct drivers and others are upward-firing drivers that project sound waves toward the ceiling of the listening environment for reflection to a specific listening area; a renderer for processing audio streams and one or more metadata sets that are associated with each audio stream and that specify a playback location in the listening environment of a respective audio stream, wherein the audio streams comprise one or more reflected audio streams and one or more direct audio streams; and a playback system for rendering the audio streams to the array of audio drivers in accordance with the one or more metadata sets, and wherein the one or more reflected audio streams are transmitted to the reflected audio drivers.

Embodiments are further directed to speakers or speaker systems that incorporate a desired frequency transfer function directly into the transducer design of the speakers configured to reflect sound off of the upper surfaces, wherein the desired frequency transfer function filters direct sound components from height sound components in an adaptive audio signal produced by a renderer.

Embodiments are yet further directed to methods of making and using or deploying the speakers, circuits, and transducer designs that optimize the rendering and playback of reflected sound content using a frequency transfer function that filters direct sound components from height sound components in an audio playback system.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
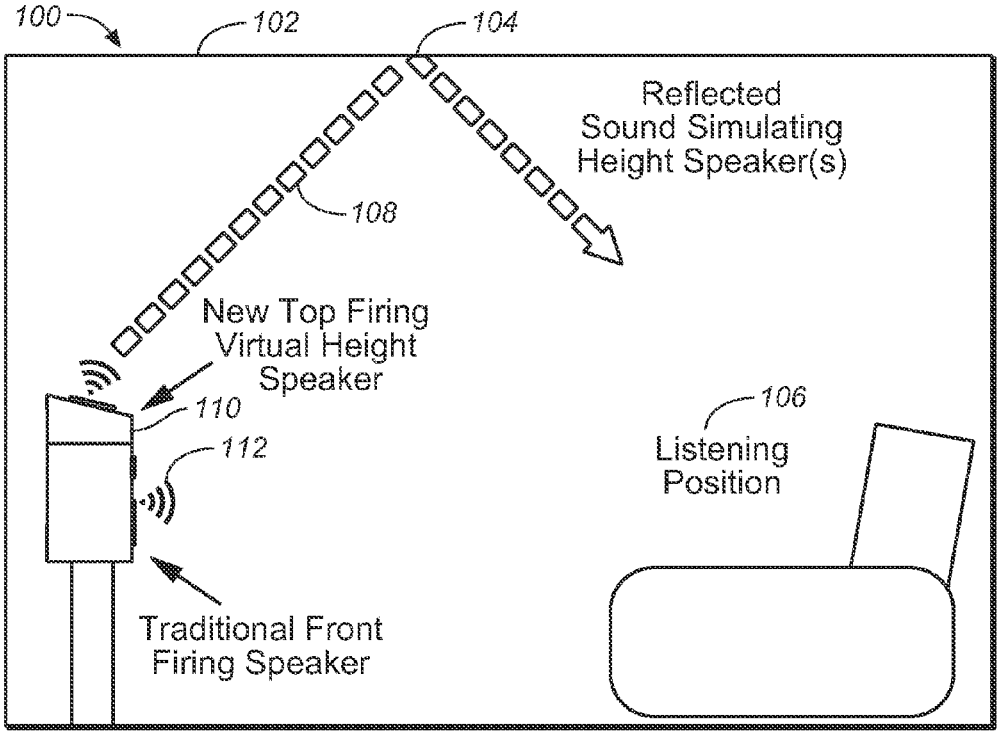
FIG. 1 illustrates the use of an upward-firing driver using reflected sound to simulate an overhead speaker in a listening environment.

Systems and methods are described for an adaptive audio system that renders reflected sound for adaptive audio systems through upward-firing speakers that incorporate virtual height filter circuits for rendering object based audio content using reflected sound to reproduce overhead sound objects and provide virtual height cues. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; and "adaptive audio" means channel-based and/or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves.

Embodiments are directed to a reflected sound rendering system that is configured to work with a sound format and processing system that may be referred to as a "spatial audio system" or "adaptive audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. An example of an adaptive audio system that may be used in conjunction with present embodiments is described in pending U.S. Provisional Patent Application 61/636,429, filed on Apr. 20, 2012 and entitled "System and Method for Adaptive Audio Signal Generation, Coding and Rendering," which is hereby incorporated by reference, and is attached hereto as Appendix 1.

In general, audio objects can be considered as groups of sound elements that may be perceived to emanate from a particular physical location or locations in the listening environment. Such objects can be static (stationary) or dynamic (moving). Audio objects are controlled by metadata that defines the position of the sound at a given point in time, along with other functions. When objects are played back, they are rendered according to the positional metadata using the speakers that are present, rather than necessarily being output to a predefined physical channel.

An example implementation of an adaptive audio system and associated audio format is the Dolby® Atmos™ platform. Such a system incorporates a height (up/down) dimension that may be implemented as a 9.1 surround system, or similar surround sound configuration (e.g., 11.1, 13.1, 19.4, etc.). A 9.1 surround system may comprise composed five speakers in the floor plane and four speakers in the height plane. In general, these speakers may be used to produce sound that is designed to emanate from any position more or less accurately within the listening environment. In a typical commercial or professional implementation speakers in the height plane are usually provided as ceiling mounted speakers or speakers mounted high on a wall above the audience, such as often seen in a cinema. These speakers provide height cues for signals that are intended to be heard above the listener by directly transmitting sound waves down to the audience from overhead locations.

Virtual Height Speaker System

In many cases, such as typical home environments, ceiling mounted overhead speakers are not available or practical to install. In this case, the height dimension must be provided by floor or low wall mounted speakers. In an embodiment, the height dimension is provided by upward-firing speakers that simulate height speakers by reflecting sound off of the ceiling. In an adaptive audio system, certain virtualization techniques are implemented by the renderer to reproduce overhead audio content through these upward-firing speakers, and the speakers use the specific information regarding which audio objects should be rendered above the standard horizontal plane to direct the audio signals accordingly.

For purposes of description, the term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers.

FIG. 1 illustrates the use of an upward-firing driver using reflected sound to simulate one or more overhead speakers. Diagram 100 illustrates an example in which a listening position 106 is located at a particular place within a listening environment. The system does not include any height speakers for transmitting audio content containing height cues. Instead, the speaker cabinet or speaker array includes an upward-firing driver along with the front firing driver(s). The upward-firing driver is configured (with respect to location and inclination angle) to send its sound wave 108 up to a particular point 104 on the ceiling 102 where it reflected back down to the listening position 106. It is assumed that the ceiling is made of an appropriate material and composition to adequately reflect sound down into the listening environment. The relevant characteristics of the upward-firing driver (e.g., size, power, location, etc.) may be selected based on the ceiling composition, room size, and other relevant characteristics of the listening environment.

The embodiment of FIG. 1 illustrates a case in which the forward firing driver or drivers are enclosed within a first cabinet 112, and the upward firing driver is enclosed within a second separate cabinet 110. The upward firing speaker 110 for the virtual height speaker is generally placed on top of the forward firing speaker 112, but other orientations are also possible. It should be noted that any number of upward-firing drivers could be used in combination to create multiple simulated height speakers. Alternatively, a number of upward-firing drivers may be configured to transmit sound to substantially the same spot on the ceiling to achieve a certain sound intensity or effect.

Figure 2:
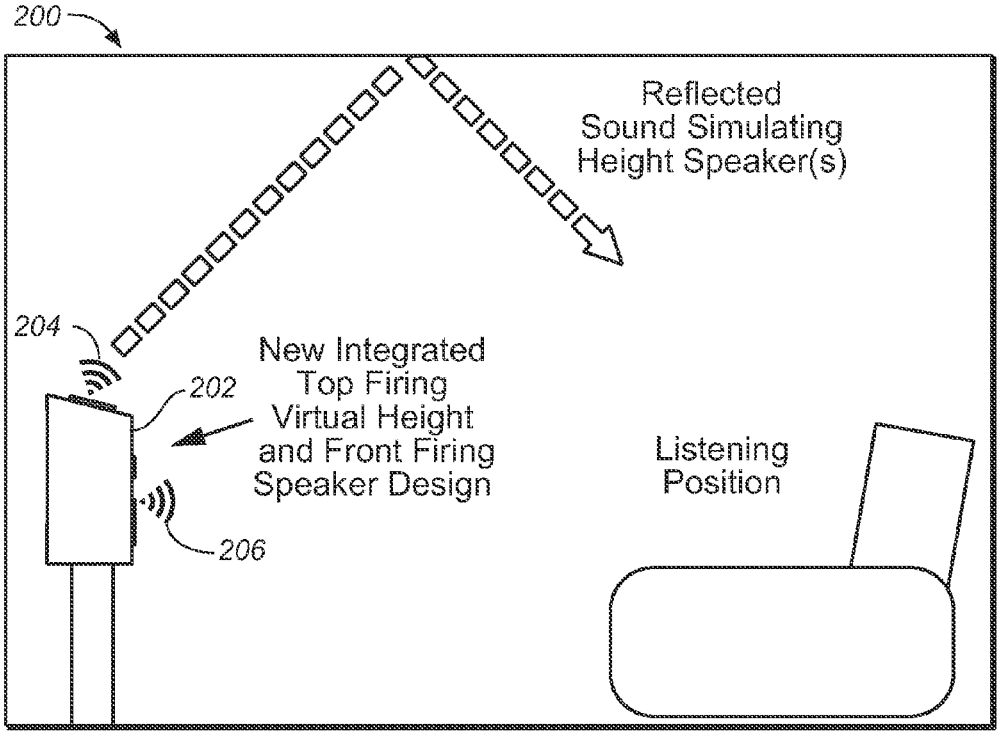
FIG. 2 illustrates an integrated virtual height and front firing speaker, under an embodiment.

FIG. 2 illustrates an embodiment in which the upward firing driver(s) and forward firing driver(s) are provided in the same cabinet. As shown in FIG. 2, speaker cabinet 202 includes both the forward firing driver 206 and the upward firing driver 204. Although only one upward-firing driver is shown in each of FIG. 1 and FIG. 2, multiple upward-firing drivers may be incorporated into a reproduction system in some embodiments. For the embodiment of FIGS. 1 and 2, it should be noted that the drivers may be of any appropriate, shape, size and type depending on the frequency response characteristics required, as well as any other relevant constraints, such as size, power rating, component cost, and so on.

As shown in FIGS. 1 and 2, the upward firing drivers are positioned such that they project sound at an angle up to the ceiling where it can then bounce back down to a listener. The angle of tilt may be set depending on listening environment characteristics and system requirements. For example, the upward driver 204 may be tilted up between 20 and 60 degrees and may be positioned above the front-firing driver 206 in the speaker enclosure 202 so as to minimize interference with the sound waves produced from the front-firing driver 206. The upward-firing driver 204 may be installed at a fixed angle, or it may be installed such that the tilt angle may be adjusted manually. Alternatively, a servo mechanism may be used to allow automatic or electrical control of the tilt angle and projection direction of the upward-firing driver. For certain sounds, such as ambient sound, the upward-firing driver may be pointed straight up out of an upper surface of the speaker enclosure 202 to create what might be referred to as a "top-firing" driver. In this case, a large component of the sound may reflect back down onto the speaker, depending on the acoustic characteristics of the ceiling. In most cases, however, some tilt angle is usually used to help project the sound through reflection off the ceiling to a different or more central location within the listening environment.

In an embodiment, the adaptive audio system utilizes upward-firing drivers to provide the height element for overhead audio objects. This is achieved partly through the perception of reflected sound from above as shown in FIGS. 1 and 2. In practice, however, sound does not radiate in a perfectly directional manner along the reflected path from the upward-firing driver. Some sound from the upward firing driver will travel along a path directly from the driver to the listener, diminishing the perception of sound from the reflected position. The amount of this undesired direct sound in comparison to the desired reflected sound is generally a function of the directivity pattern of the upward firing driver or drivers. To compensate for this undesired direct sound, it has been shown that incorporating signal processing to introduce perceptual height cues into the audio signal being fed to the upward-firing drivers improves the positioning and perceived quality of the virtual height signal. For example, a directional hearing model has been developed to create a virtual height filter, which when used to process audio being reproduced by an upward-firing driver, improves that perceived quality of the reproduction. In an embodiment, the virtual height filter is derived from both the physical speaker location (approximately level with the listener) and the reflected speaker location (above the listener) with respect to the listening position. For the physical speaker location, a first directional filter is determined based on a model of sound travelling directly from the speaker location to the ears of a listener at the listening position. Such a filter may be derived from a model of directional hearing such as a database of HRTF (head related transfer function) measurements or a parametric binaural hearing model, pinna model, or other similar transfer function model that utilizes cues that help perceive height. Although a model that takes into account pinna models is generally useful as it helps define how height is perceived, the filter function is not intended to isolate pinna effects, but rather to process a ratio of sound levels from one direction to another direction, and the pinna model is an example of one such model of a binaural hearing model that may be used, though others may be used as well.

An inverse of this filter is next determined and used to remove the directional cues for audio travelling along a path directly from the physical speaker location to the listener. Next, for the reflected speaker location, a second directional filter is determined based on a model of sound travelling directly from the reflected speaker location to the ears of a listener at the same listening position using the same model of directional hearing. This filter is applied directly, essentially imparting the directional cues the ear would receive if the sound were emanating from the reflected speaker location above the listener. In practice, these filters may be combined in a way that allows for a single filter that both at least partially removes the directional cues from the physical speaker location, and at least partially inserts the directional cues from the reflected speaker location. Such a single filter provides a frequency response curve that is referred to herein as a "height filter transfer function," "virtual height filter response curve," "desired frequency transfer function," "height cue response curve," or similar words to describe a filter or filter response curve that filters direct sound components from height sound components in an audio playback system.

With regard to the filter model, if $P_1$ represents the frequency response in dB of the first filter modeling sound transmission from the physical speaker location and $P_2$ represents the frequency response in dB of the second filter modeling sound transmission from the reflected speaker position, then the total response of the virtual height filter $P_T$ in dB can be expressed as: $P_T=\alpha(P_2-P_1)$, where a is a scaling factor that controls the strength of the filter. With $\alpha=1$, the filter is applied maximally, and with $\alpha=0$, the filter does nothing (0 dB response). In practice, a is set somewhere between 0 and 1 (e.g. $\alpha=0.5$) based on the relative balance of reflected to direct sound. As the level of the direct sound increases in comparison to the reflected sound, so should $\alpha$ in order to more fully impart the directional cues of the reflected speaker position to this undesired direct sound path. However, $\alpha$ should not be made so large as to damage the perceived timbre of audio travelling along the reflected path, which already contains the proper directional cues. In practice a value of $\alpha=0.5$ has been found to work well with the directivity patterns of standard speaker drivers in an upward firing configuration. In general, the exact values of the filters $P_1$ and $P_2$ will be a function of the azimuth of the physical speaker location with respect to the listener and the elevation of the reflected speaker location. This elevation is in turn a function of the distance of the physical speaker location from the listener and the difference between the height of the ceiling and the height of the speaker (assuming the listener's head is at the same height of the speaker).

Figure 3:
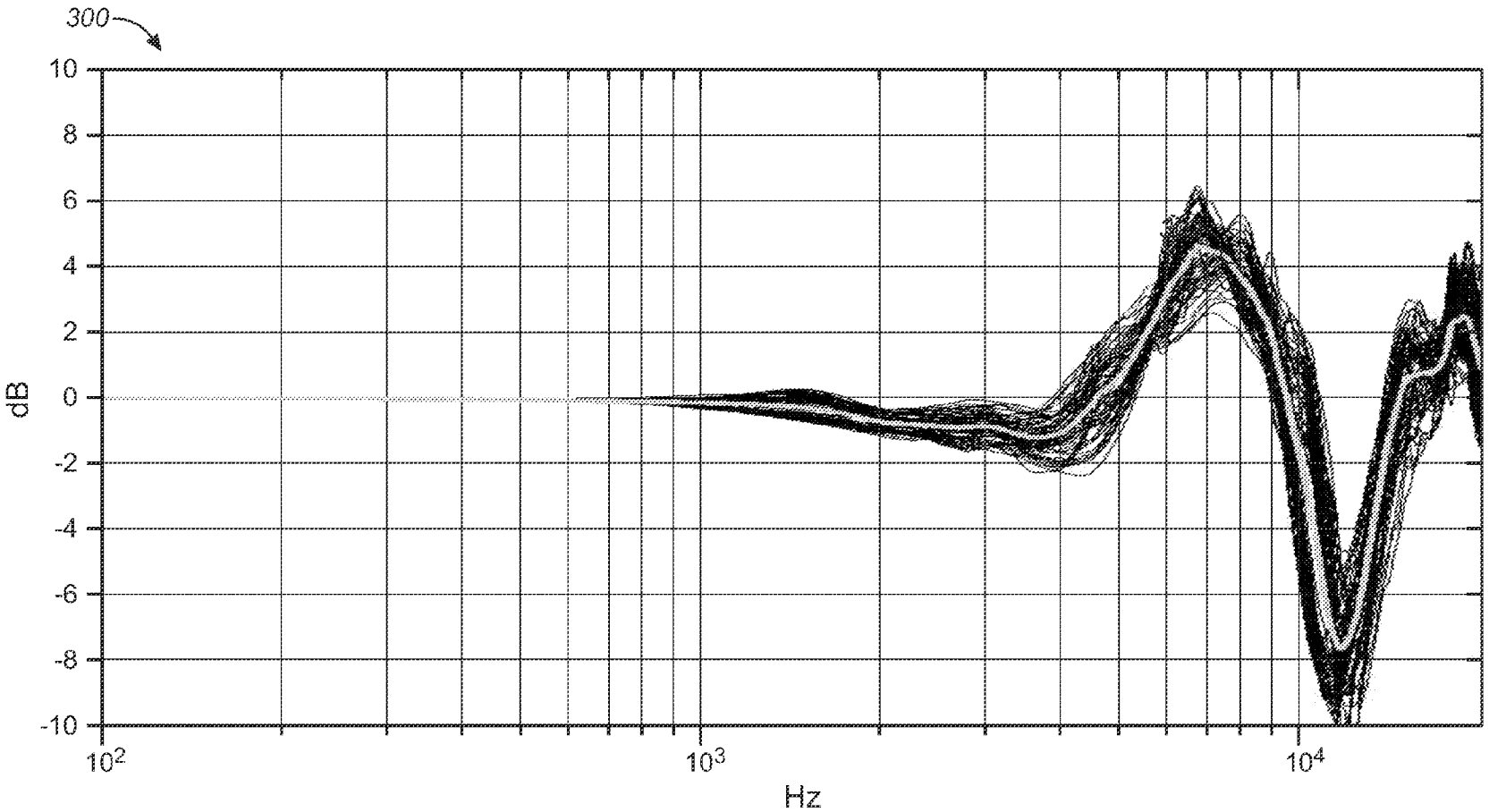
FIG. 3 is a graph that illustrates the magnitude response of a virtual height filter derived from a directional hearing model, under an embodiment.

FIG. 3 depicts virtual height filter responses $P_T$ with $\alpha=1$ derived from a directional hearing model based on a database of HRTF responses averaged across a large set of subjects. The black lines 303 represent the filter $P_T$ computed over a range of azimuth angles and a range of elevation angles corresponding to reasonable speaker distances and ceiling heights. Looking at these various instances of $P_T$, one first notes that the majority of each filter's variation occurs at higher frequencies, above 4 Hz. In addition, each filter exhibits a peak located at roughly 7 kHz and a notch at roughly 12 kHz. The exact level of the peak and notch vary a few dB between the various responses curves. Given this close agreement in location of peak and notch between the set of responses, it has been found that a single average filter response 302, given by the thick gray line, may serve as a universal height cue filter for most reasonable physical speaker locations and room dimensions. Given this finding, a single filter $P_T$ may be designed for a virtual height speaker, and no knowledge of the exact speaker location and room dimensions is required for reasonable performance. For increased performance, however, such knowledge may be utilized to dynamically set the filter $P_T$ to one of the particular black curves in FIG. 3, corresponding to the specific speaker location and room dimensions.

Figure 4A:
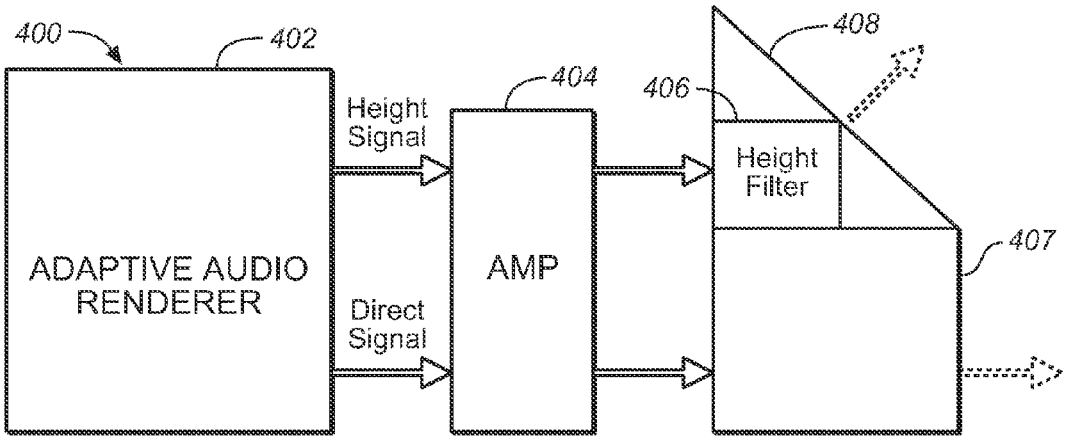
FIG. 4A illustrates a virtual height filter incorporated as part of a speaker unit having an upward firing driver, under an embodiment.

The typical use of such a virtual height filter for virtual height rendering is for audio to be pre-processed by a filter exhibiting one of the magnitude responses depicted in FIG. 3 (e.g. average curve 302), before it is played through the upward-firing virtual height speaker. The filter may be provided as part of the speaker unit, or it may be a separate component that is provided as part of the renderer, amplifier, or other intermediate audio processing component. FIG. 4A illustrates a virtual height filter incorporated as part of a speaker unit having an upward firing driver, under an embodiment. As shown in system 400 of FIG. 4A, an adaptive audio processor 402 outputs audio signals that contain separate height signal components and direct signal components. The height signal components are meant to be played through an upward firing speaker 408, and the direct audio signal component is meant to be played through a direct or forward firing speaker 407. The signal components are not necessarily different in terms of frequency content or audio content, but are instead differentiated on the basis of height cues present in the audio objects or signals. For the embodiment of FIG. 4A, a height filter 406 contained within or otherwise associated with the height speaker 408. The height filter 406 compensates for any undesired direct sound direct sound components that may be present in the height signal by providing perceptual height cues into the height signal to improve the positioning and perceived quality of the virtual signal. Such a height filter may incorporate the reference curve shown in FIG. 3.

Figure 4B:
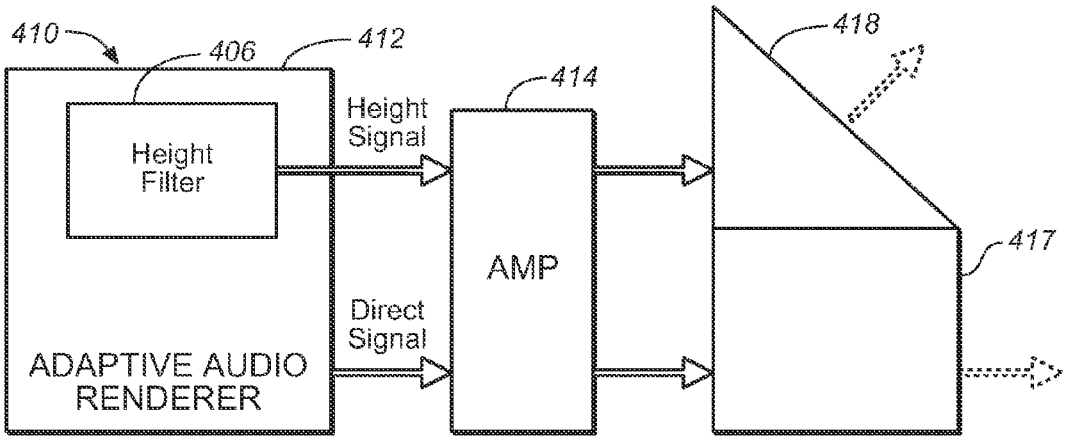
FIG. 4B illustrates a virtual height filter incorporated as part of a rendering unit for driving an upward firing driver, under an embodiment.

In an alternative embodiment, the virtual height filter pre-processing can take place in the rendering equipment prior to input to a speaker amplifier (i.e., an AV receiver or preamp). FIG. 4B illustrates a virtual height filter incorporated as part of a rendering unit for driving an upward firing driver, under an embodiment. As shown in system 410 of FIG. 4B, renderer 412 outputs separate height and direct signals through amp 414 to drive upward firing speakers 418 and direct speakers 417, respectively. A height filter 416 within the renderer 412 provides the direct sound compensation through a notch filter (e.g., reference curve 302) for the upward firing speaker 418, as described above with respect to FIG. 4A. This allows the height filter function to be provided for speakers that do not have any built-in virtual height filtering.

Figure 5:
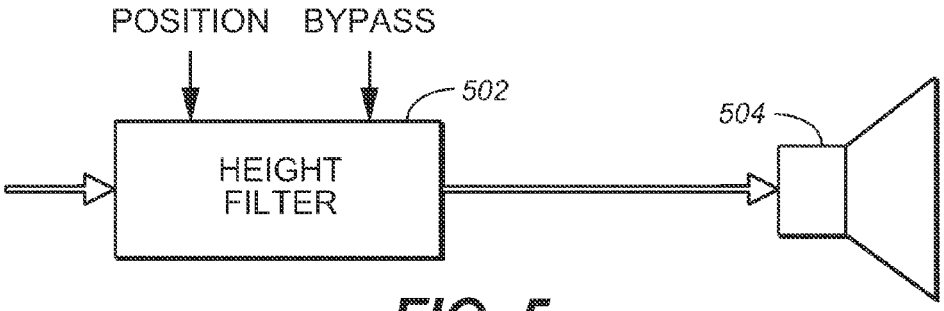
FIG. 5 illustrates a height filter receiving positional information and a bypass signal, under an embodiment.
Figure 6:
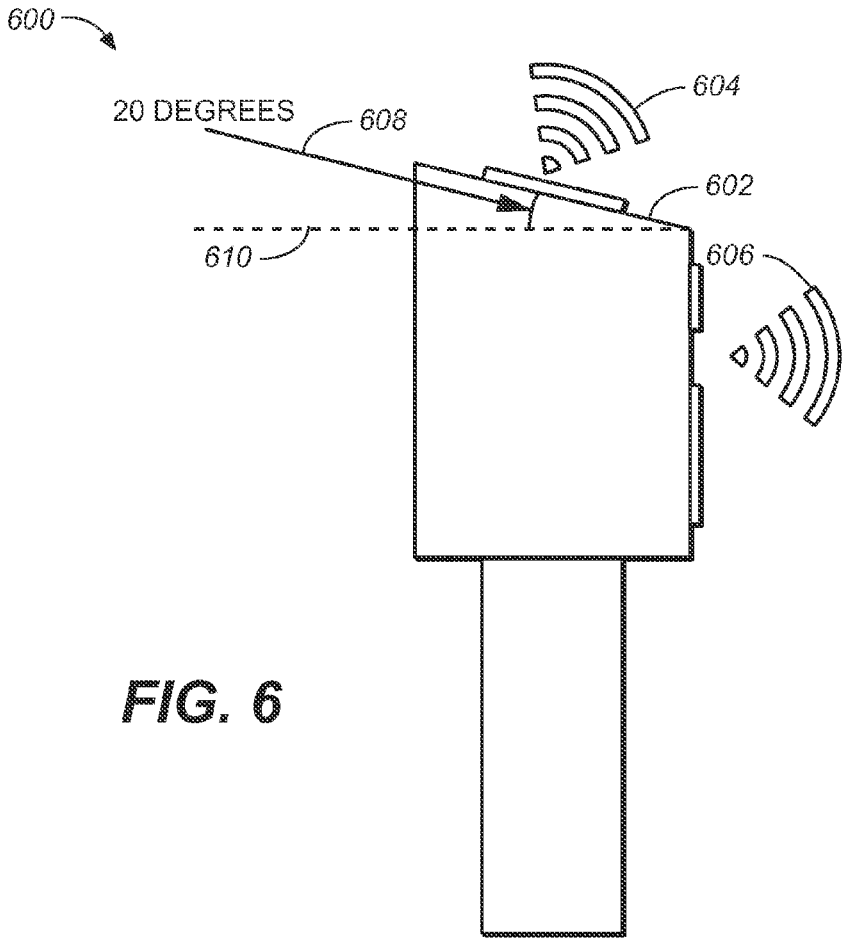
FIG. 6 illustrates an inclination angle of an upward-firing driver used in a virtual height speaker, under an embodiment.

In an embodiment, certain positional information is provided to the height filter, along with a bypass signal to enable or disable the virtual height filter within the speaker system. FIG. 5 illustrates a height filter receiving positional information and a bypass signal, under an embodiment. As shown in FIG. 5, positional information is provided to the virtual height filter 502, which is connected to the upward firing speaker 504. The positional information may include speaker position and room size utilized for the selection of the proper virtual height filter response from the set depicted in FIG. 3. In addition, this positional data may be utilized to vary the inclination angle of the virtual height speaker 504 if such angle is made adjustable through either automatic or manual means. A typical and effective angle for most cases is approximately 20 degrees. FIG. 6 illustrates an inclination angle of an upward-firing driver used in a virtual height speaker, under an embodiment. As shown in diagram 600, speaker cabinet 602 includes forward-firing driver(s) 606 and upward-firing driver 604. The upward-firing driver is positioned at an angle 608 relative to the ground or horizontal plane defining the axis of transmission 610 of the forward-firing driver 606. FIG. 6 illustrates an example case in which angle=20 degrees. As discussed earlier, however, the angle should ideally be set to maximize the ratio of reflected to direct sound at the listening position. If the directivity pattern of the upward firing speaker is known, then the optimal angle may be computed given the exact speaker distance and ceiling height, and the angle 608 may then be adjusted if the upward-firing driver 604 is movable with respect to the forward firing driver 606, such as through a hinged cabinet or servo-controlled arrangement. Depending on implementation of the control circuitry (e.g., either analog, digital, or electromechanical), such positional information can be provided through electrical signaling methods, electromechanical means, or other similar mechanisms In certain scenarios, additional information about the listening environment may necessitate further adjustment of the inclination angle through either manual or automatic means. This may include cases where the ceiling is very absorptive or unusually high. In such cases, the amount of sound travelling along the reflected path may be diminished, and it may therefore be desirable to tilt the driver further forward to increase the amount of direct path signal from the driver to increase reproduction efficiency. As this direct path component increases, it is then desirable to increase the filter scaling parameter $\alpha$, as explained earlier. As such this filter scaling parameter $\alpha$ may be set automatically as a function of the variable inclination angle as well as the other variables relevant to the reflected to direct sound ratio. For the embodiment of FIG. 6, the virtual height filter 502 also receives a bypass signal, which allows that filter to be cut out of the circuit if virtual height filtering is not desired.

As shown in FIGS. 4A and 4B, the renderer outputs separate height and direct signals to directly the respective upward firing and direct speakers. Alternatively, the renderer could output a single audio signal that is separated into height and direct components by a discrete separation or crossover circuit. In this case, the audio output from the renderer would be separated into its constituent height and direct components by a separate circuit. In certain cases the height and direct components are not frequency dependent and an external separation circuit is used to separate the audio into height and direct sound components and route these signals to the appropriate respective drivers, where virtual height filtering would be applied to the upward firing speaker signal.

Figure 7:
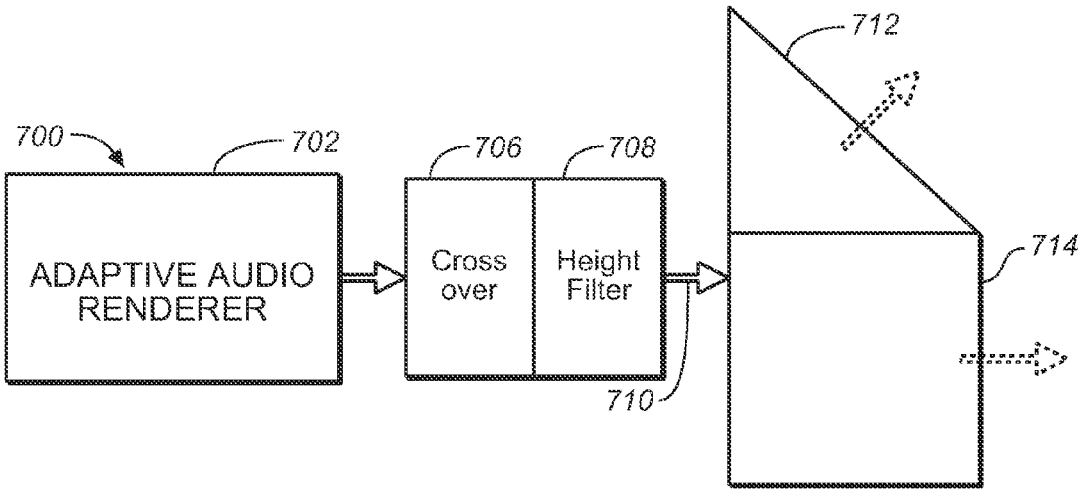
FIG. 7 is a diagram illustrating a virtual height filter system including crossover circuit, under an embodiment.

In most common cases, however, the height and direct components may be frequency dependent, and the separation circuit comprises crossover circuit that separates the full-bandwidth signal into low and high (or bandpass) components for transmission to the appropriate drivers. This is often the most useful case since height cues are typically more prevalent in high frequency signals rather than low frequency signals, and for this application, a crossover circuit may be used in conjunction with or integrated in the virtual height filter component to route high frequency signals to the upward firing driver(s) and lower frequency signals to the direct firing driver(s). FIG. 7 is a diagram illustrating a virtual height filter system including crossover circuit, under an embodiment. As shown in system 700, output from the renderer 702 through an amp (not shown) is a full bandwidth signal and a virtual height speaker filter 708 is used to impart the desired height filter transfer function for signals sent to the upward firing speaker 712. A crossover circuit 706 separates the full bandwidth signal from renderer 702 into high (upper) and low (direct) frequency components for transmission to the appropriate speakers 712 (upward firing) and 714 (direct). The crossover 706 may be integrated with or separate from the height filter 708, and these separate or combined circuits may be provided anywhere within the signal processing chain, such as between the renderer and speaker system (as shown), as part of an amp or pre-amp in the chain, within the speaker system itself, or as components closely coupled or integrated within the renderer 702. The crossover function may be implemented prior to or after the virtual height filtering function.

Figure 8A:
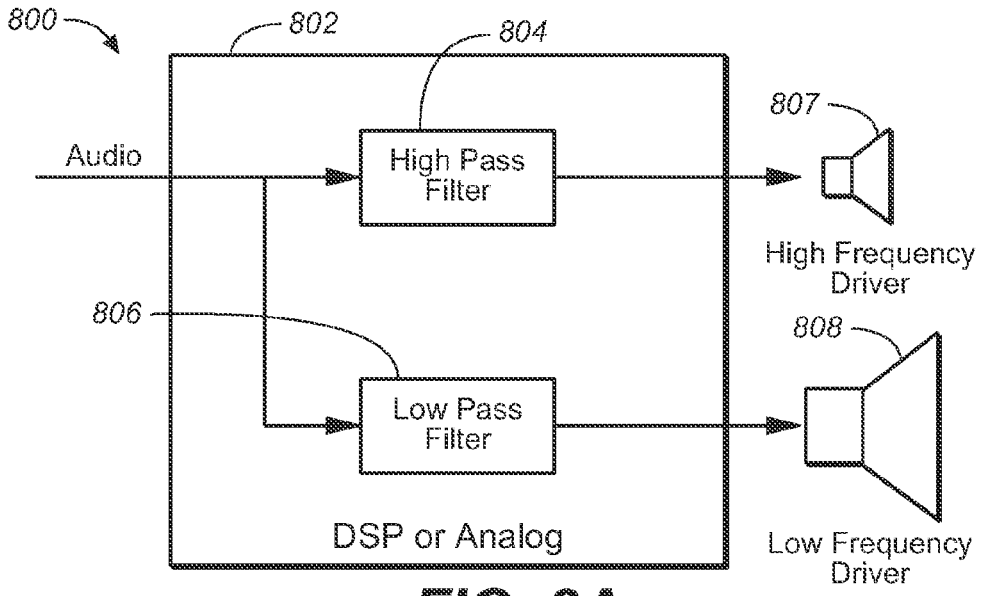
FIG. 8A is a high-level circuit diagram of a two-band crossover filter used in conjunction with a virtual height filter, under an embodiment.

A crossover circuit typically separates the audio into two or three frequency bands with filtered audio from the different bands being sent to the appropriate drivers within the speaker. For example in a two-band crossover, the lower frequencies are sent to a larger driver capable of faithfully reproducing low frequencies (e.g., woofer/midranges) and the higher frequencies are typically sent to smaller transducers (e.g., tweeters) that are more capable of faithfully reproducing higher frequencies. FIG. 8A is a high-level circuit diagram of a two-band crossover filter used in conjunction with a virtual height filter, such as shown in FIG. 7, under an embodiment. With reference to diagram 800, an audio signal input to crossover circuit 802 is sent to a high-pass filter 804 and a low-pass filter 806. The crossover 802 is set or programmed with a particular cut-off frequency that defines the crossover point. This frequency may be static or it may be variable (i.e., through a variable resistor circuit in an analog implementation or a variable crossover parameter in a digital implementation). The high-pass filter 804 cuts the low frequency signals (those below the cut-off frequency) and sends the high frequency component to the high frequency driver 807. Similarly, the low-pass filter 806 cuts the high frequencies (those above the cut-off frequency) and sends the low frequency component to the low frequency driver 808. A three-way crossover functions similarly except that there are two crossover points and three band-pass filters to separate the input audio signal into three bands for transmission to three separate drivers, such as tweeters, mid-ranges, and woofers.

The crossover circuit 802 may be implemented as an analog circuit using known analog components (e.g., capacitors, inductors, resistors, etc.) and known circuit designs. Alternatively, it may be implemented as a digital circuit using digital signal processor (DSP) components, logic gates, programmable arrays, or other digital circuits.

Figure 8B:
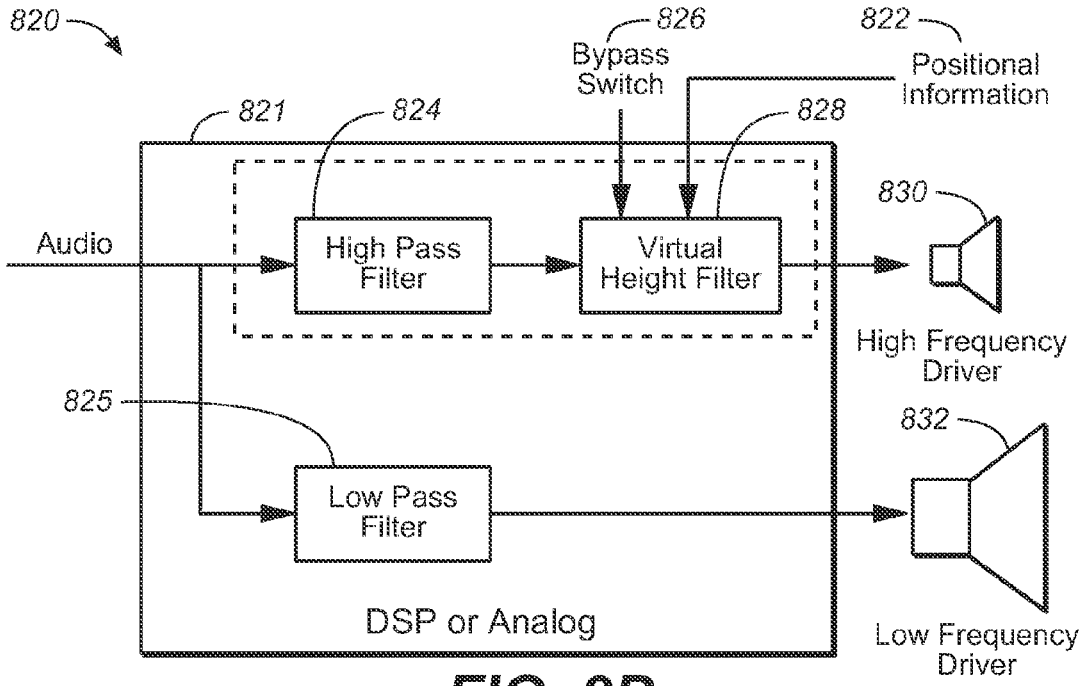
FIG. 8B illustrates a two-band crossover that implements virtual height filtering in the high-pass filtering path, under an embodiment.

The crossover circuit of FIG. 8A can used to implement at least a portion of the virtual height filter, such as virtual height filter 702 of FIG. 7. As seen in FIG. 3, most of the virtual height filtering takes place at frequencies above 4 kHz, which is higher than the cut-off frequency for many two-way crossovers. FIG. 8B illustrates a two-band crossover that implements virtual height filtering in the high-pass filtering path, under an embodiment. As shown in diagram 820, crossover 821 includes low-pass filter 825 and high-pass-filter 824. The high-pass filter is part of a circuit 820 that includes a virtual height filter component 828. This virtual height filter applies the desired height filter response, such as curve 302, to the high-pass filtered signal prior to transmission to the high-frequency driver 830.

A bypass switch 826 may be provided to allow the system or user to bypass the virtual height filter circuit during calibration or setup operations so that other audio signal processes can operate without interfering with the virtual height filter. The switch 826 can either be a manual user operated toggle switch that is provided on the speaker or rendering component where the filter circuit resides, or it may be an electronic switch controlled by software, or any other appropriate type of switch. Positional information 822 may also be provided to the virtual height filter 828.

The embodiment of FIG. 8B illustrates a virtual height filter used with the high-pass filter stage of a crossover. It should be noted in an alternative embodiment, a virtual height filter may be used with the low-pass filter so that that the lower frequency band could also be modified so as to mimic the lower frequencies of the response as shown in FIG. 3. However, in most practical applications, the crossover may be unduly complicated in light of the minimal height cues present in the low-frequency range.

Figure 9:
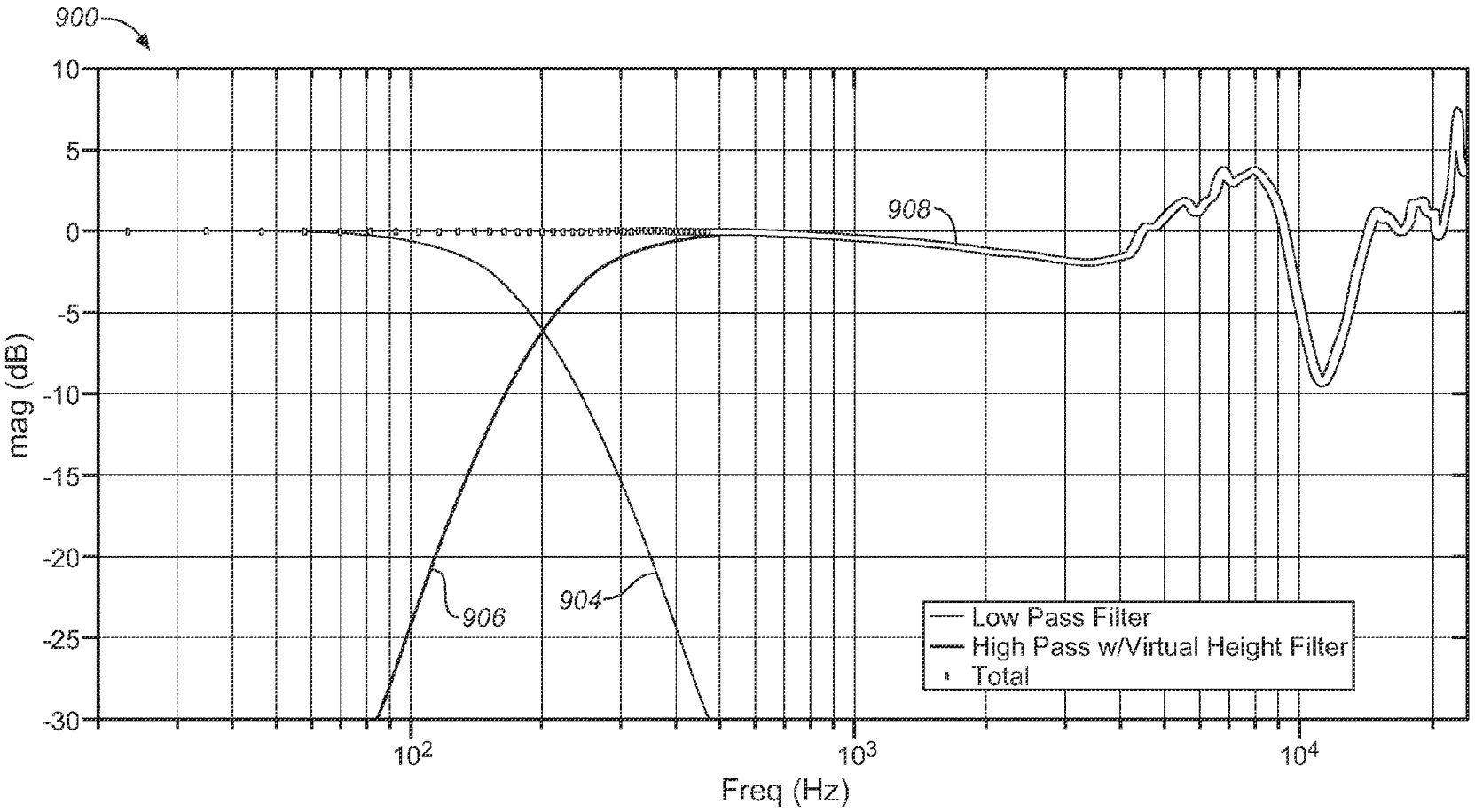
FIG. 9 shows the frequency response of the two-band crossover of FIG. 8, under an embodiment.

FIG. 9 illustrates the frequency response of the two-band crossover of FIG. 8B, under an embodiment. As shown in diagram 900, the crossover has a cut-off frequency of 902 to create a frequency response curve 904 of the low-pass filter that cuts frequencies above the cut-off frequency 902, and a frequency response curve 906 for the high-pass filter that cuts frequencies below the cut-off frequency 902. The virtual height filter curve 908 is superimposed over the high-pass filter curve 906 when the virtual height filter is applied to the audio signal after the high-pass filter stage.

The crossover implementation shown in FIG. 8B assumes that the upward-firing virtual height speaker is implemented using two drivers, one for low frequencies and one for high frequencies. However, this configuration may not be ideal under most conditions. Specific and controlled directionality of an upward-firing speaker is often critical for effective virtualization. For example, a single transducer speaker is usually more effective when implementing the virtual height speaker. Additionally, a smaller, single transducer (e.g., 3" in diameter) is preferred as it is more directional at higher frequencies and more affordable than a larger transducer.

Figure 10:
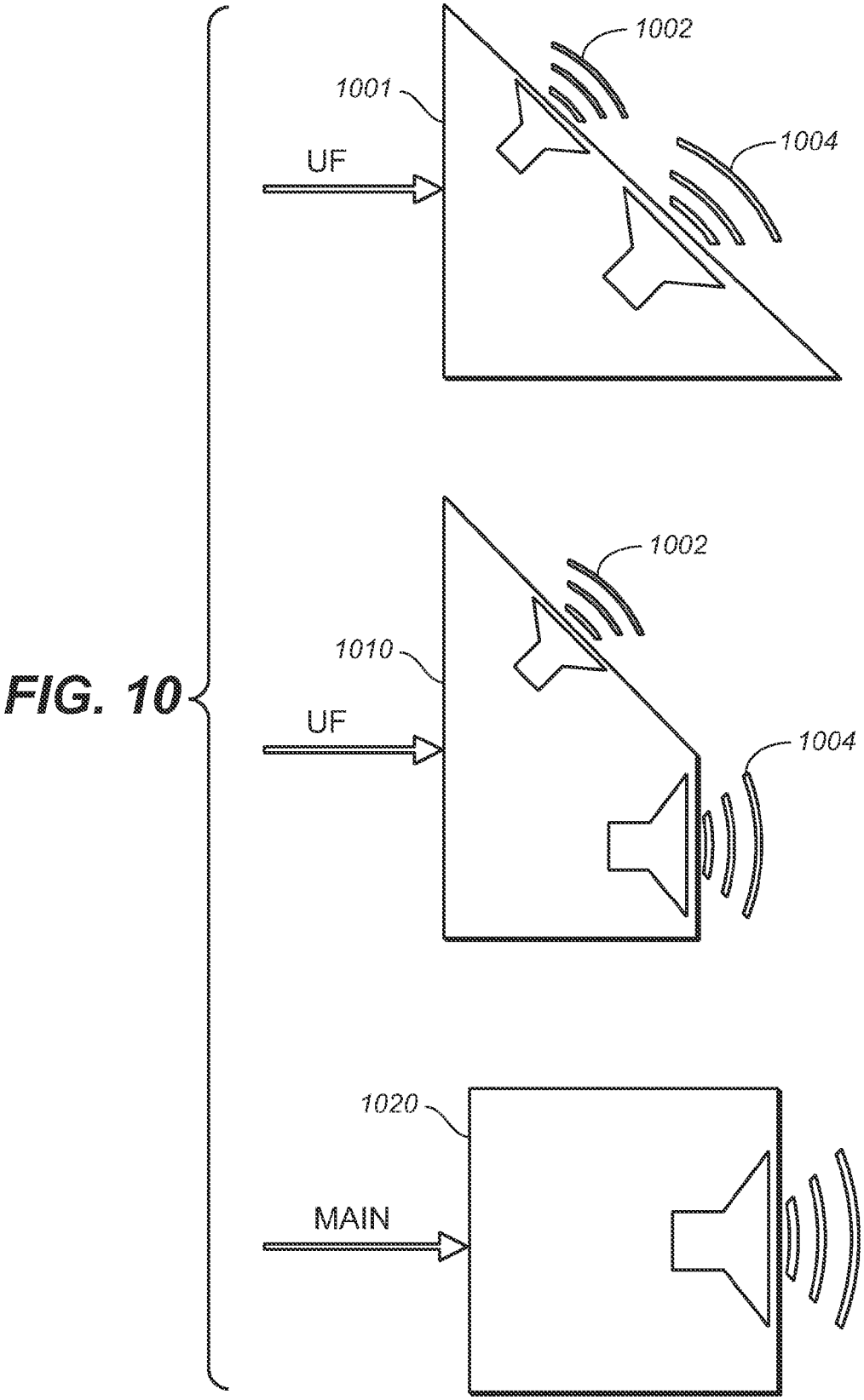
FIG. 10 illustrates various different upward-firing and direct or front-firing speakers configurations for use with a virtual height filter, under an embodiment.

In an embodiment, the upward firing speaker may comprise a pair or array of two or more speakers of different sizes and/or characteristics. FIG. 10 illustrates various different upward-firing and direct or front-firing speakers configurations for use with a virtual height filter, under an embodiment. As shown in FIG. 10, an upward firing speaker may include two drivers 1002 and 1004 both mounted within the same cabinet 1001 to fire upwards at the same angle. The drivers may be of the same configuration or they may be of different configurations (size, power, frequency response, etc.), depending on application needs. The upward firing (UF) audio signal is transmitted to this speaker 1001 and internal processing may be used to send appropriate audio to either or both of the drivers 1002 and 1004. In an alternative embodiment, one of the upward firing drivers, e.g., 1004 may be angled differently to the other driver, as shown in speaker 1010. In this case upward firing driver 1004 is directed to fire substantially frontward out of the cabinet 1010. It should be noted that any appropriate angle may be selected for either or both of drivers 1002 and 1004, and that the speaker configuration may include any appropriate number of drivers or driver arrays of various types (cone, ribbon, horn, etc.). In an embodiment, the upward firing speakers 1001 and 1002 may be mounted on a forward or direct firing speaker 1020 that includes one or more drivers 1020 that transmits sound directly out from the main cabinet. This speaker receives the main audio input signal, as separate from the UF audio signal.

Figure 8C:
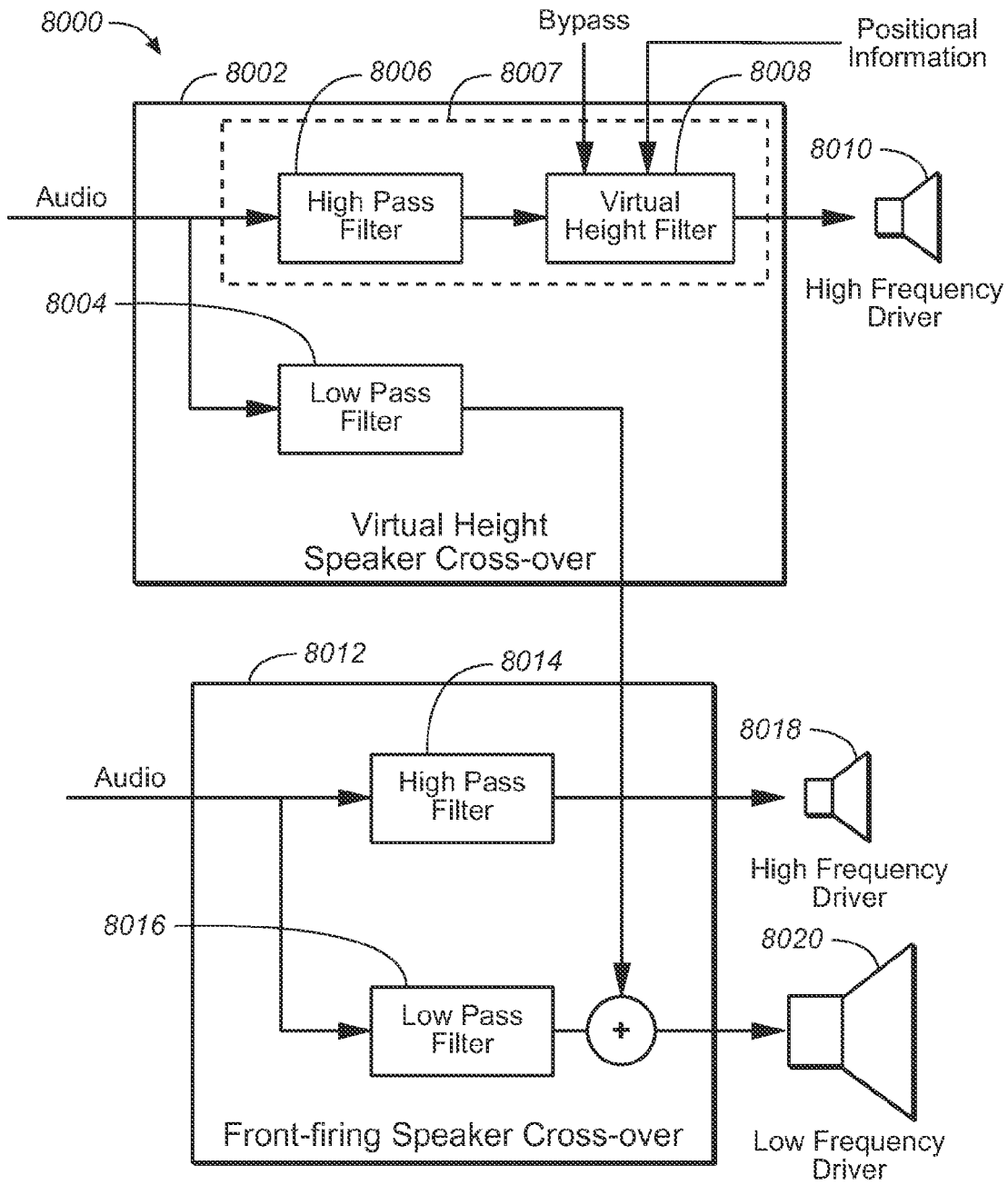
FIG. 8C illustrates a crossover that combines upward-firing and front-firing speaker crossover filter networks for use with different high-frequency drivers, under an embodiment.

FIG. 8C illustrates a crossover that combines upward-firing and front-firing speaker crossover filter networks for use with different high-frequency drivers, such as shown in FIG. 10, under an embodiment. Diagram 8000 illustrates an embodiment in which separate crossovers are provided for the front-firing speaker and the virtual height speaker. The front firing speaker crossover 8012 comprises a low-pass filter 8016 that feeds low-frequency driver 8020 and a high-pass filter 8014 that feeds high-frequency driver 8018. The virtual height speaker crossover 8002 includes a low-pass filter 8004 that also feeds low-frequency driver 8020 through combination with the output of low-pass filter 8016 in crossover 8012. The virtual height crossover 8002 includes a high-pass filter 8006 that incorporates virtual height filter function 8008. The output of this component 8007 feeds high frequency driver 8010. Driver 8010 is an upward-firing driver and is typically a smaller and possibly different composition driver than the front-firing low-frequency driver 8020. As an example, the effective frequency range for front-facing driver low frequency driver 8020 may be set from 40 Hz to 2 Khz, for front-facing high frequency driver 8018 from 2 Khz to 20 kHz, and for upward-firing high frequency driver 8010 from 400 Hz to 20 kHz.

There are several benefits from combining the crossover networks for the top and forward firing speakers as shown in FIG. 10. First, the preferred smaller driver will not be able to effectively reproduce lower frequencies and may actually distort at loud levels. Therefore filtering and redirecting the low frequencies to the front firing speaker's low frequency drivers will allow the smaller single speaker to be used for the virtual height speaker and result in greater fidelity. Additionally, research has shown that there is little virtual height effect for audio signals below 400 Hz, so sending only higher frequencies to the virtual height speaker 1010 represents an optimum use of that driver.

Room Correction with Virtual Height Speakers

As discussed above, adding virtual height filtering to a virtual height speaker adds perceptual cues to the audio signal that add or improve the perception of height to upward-firing speakers. Incorporating virtual height filtering techniques into speakers and/or renderers may need to account for other audio signal processes performed by playback equipment. One such process is room correction, which is a process that is common in commercially available AVRs. Room correction techniques utilize a microphone placed in the listening environment to measure the time and frequency response of audio test signals played back through an AVR with connected speakers. The purpose of the test signals and microphone measurement is to measure and compensate for several key factors, such as the acoustical effects of the room and environment on the audio, including room nodes (nulls and peaks), non-ideal frequency response of the playback speakers, time delays between multiple speakers and the listening position, and other similar factors. Automatic frequency equalization and/or volume compensation may be applied to the signal to overcome any effects detected by the room correction system. For example, for the first two factors, equalization is typically used to modify the audio played back through the AVR/speaker system, in order to adjust the frequency response magnitude of the audio so that room nodes (peaks and notches) and speaker response inaccuracies are corrected.

If virtual height speakers are used in the system and virtual filtering is enabled, a room correction system may detect the virtual height filter as a room node or speaker anomaly and attempt to equalize the virtual height magnitude response to be flat. This attempted correction is especially noticeable if the virtual height filter exhibits a pronounced high frequency notch, such as when the inclination angle is relatively high.

Figure 11:
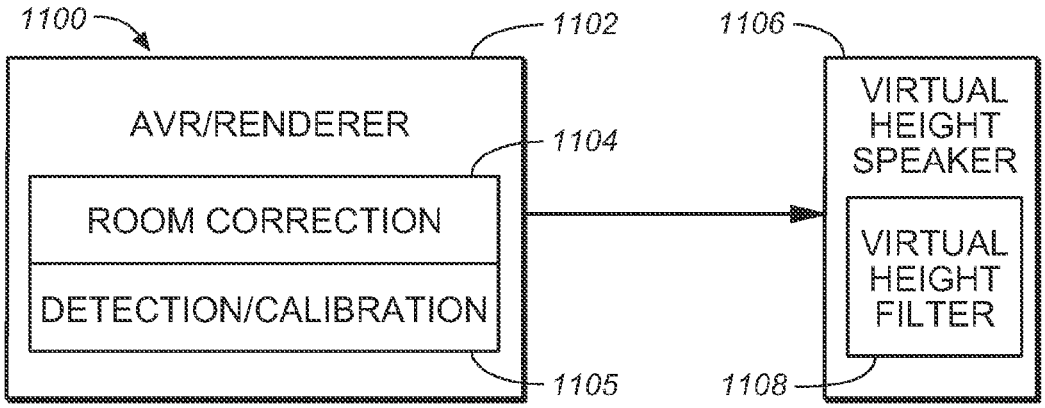
FIG. 11 is a block diagram of a virtual height rendering system that includes room correction and virtual height speaker detection capabilities, under an embodiment.

Embodiments of a virtual height speaker system include techniques and components to prevent a room correction system from undoing the virtual height filtering. FIG. 11 is a block diagram of a virtual height rendering system that includes room correction and virtual height speaker detection capabilities, under an embodiment. As shown in diagram 1100, an AVR or other rendering component 1102 is connected to one or more virtual height speakers 1106 that incorporates a virtual height filter process 1108. This filter produces a frequency response, such as illustrated in FIG. 7, which may be susceptible to room correction 1104 or other anomaly compensation techniques performed by renderer 1102.

In an embodiment, the room correction compensation component includes a component 1105 that allows the AVR or other rendering component to detect that a virtual height speaker is connected to it. One such detection technique is the use of a room calibration user interface and a speaker definition that specifies a type of speaker as a virtual or non-virtual height speaker. Present audio systems often include an interface that ask the user to specify the size of the speaker in each speaker location, such as small, medium, large. In an embodiment, a virtual height speaker type is added to this definition set. Thus, the system can anticipate the presence of virtual height speakers through an additional data element, such as small, medium, large, virtual height, etc. In an alternative embodiment, a virtual height speaker may include signaling hardware that states that it is a virtual height speaker as opposed to a non-virtual height speaker. In this case, a rendering device (such as an AVR) could probe the speakers and look for information regarding whether any particular speaker incorporates virtual height technology. This data could be provided via a defined communication protocol, which could be wireless, direct digital connection or via a dedicated analog path using existing speaker wire or separate connection. In a further alternative embodiment, detection can be performed through the use of test signals and measurement procedures that are configured or modified to identify the unique frequency characteristics of a virtual height filter in a speaker and determine that a virtual height speaker is connected via analysis of the measured test signal.

Once a rendering device with room correction capabilities has detected the presence of a virtual height speaker (or speakers) connected to the system, a calibration process 1105 is performed to correctly calibrate the system without adversely affecting the virtual height filtering function 1108. In one embodiment, calibration can be performed using a communication protocol that allows the rendering device to have the virtual height speaker 1106 bypass the virtual height filtering process 1108. This could be done if the speaker is active and can bypass the filtering. The bypass function may be implemented as a user selectable switch, or it may be implemented as a software instruction (e.g., if the filter 1108 is implemented in a DSP), or as an analog signal (e.g., if the filter is implemented as an analog circuit).

Figure 12:
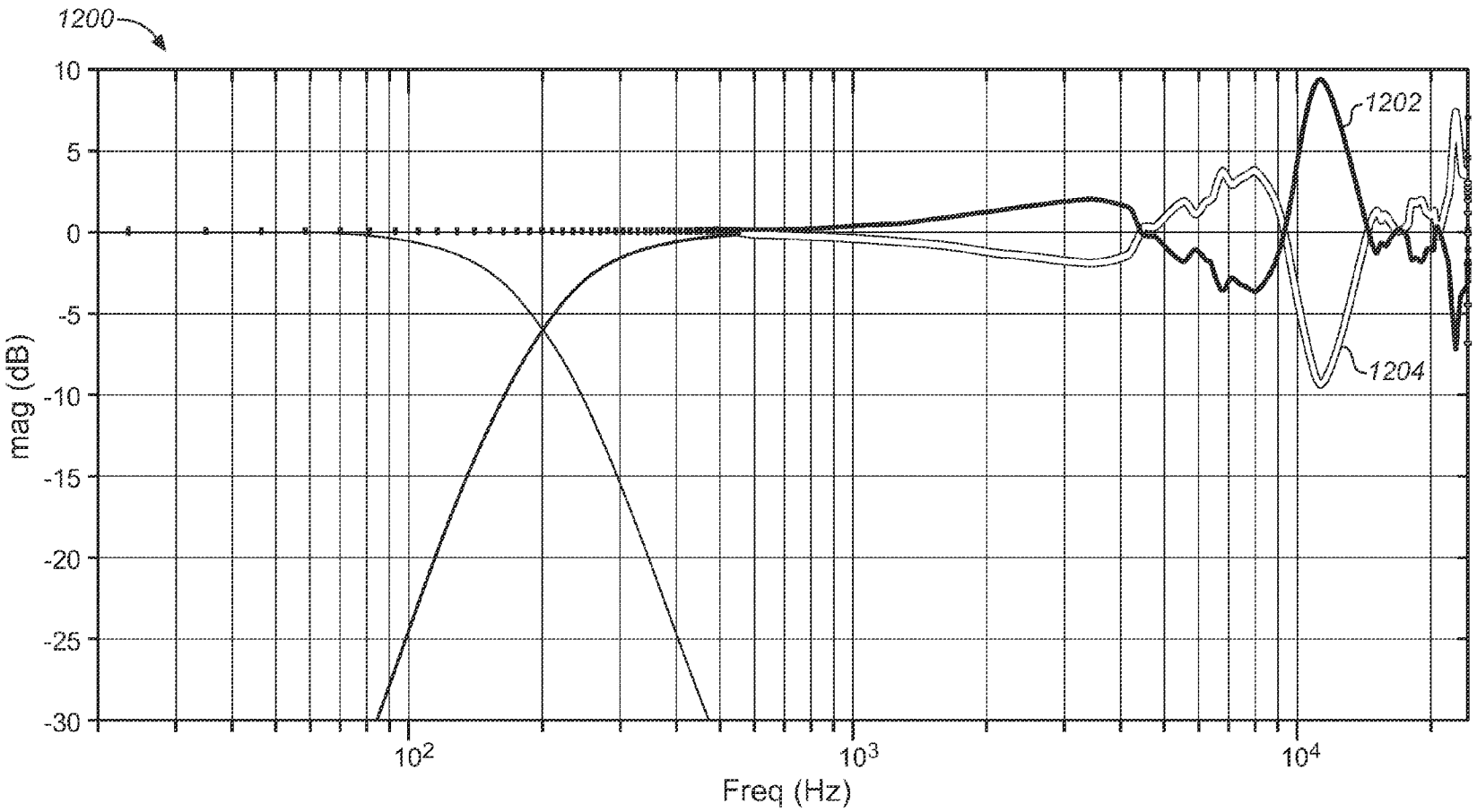
FIG. 12 is a graph that displays the effect of pre-emphasis filtering for calibration, under an embodiment.

In an alternative embodiment, system calibration can be performed using pre-emphasis filtering. In this embodiment, the room correction algorithm 1104 performs pre-emphasis filtering on the test signal it generates and outputs to the speakers for use in the calibration process. FIG. 12 is a graph that displays the effect of pre-emphasis filtering for calibration, under an embodiment. Plot 1200 illustrates a typical frequency response for a virtual height filter 1204, and a complimentary pre-emphasis filter frequency response 1202. The pre-emphasis filter is applied to the audio test signal used in the room calibration process, so that when played back through the virtual height speaker, the effect of the filter is cancelled, as shown by the complementary plots of the two curves 1202 and 1204 in the upper frequency range of plot 1200. In this way, calibration would be applied as if using a normal, non-virtual height speaker.

In yet a further alternative embodiment, calibration can be performed by adding the virtual height filter response to the target response of the calibration system.

In either of these two cases (pre-emphasis filter or modification of target response), the virtual height filter used to modify the calibration procedure may be chosen to match exactly the filter utilized in the speaker. If, however, the virtual height filter utilized inside the speaker is a universal filter, such as curve 302, which is not modified as a function of the speaker location and room dimensions, then the calibration system may instead select a virtual height filter response corresponding to the actual location and dimensions if such information is available to the system. In this way, the calibration system applies a correction equivalent to the difference between the more precise, location dependent virtual height filter response and the universal response utilized in the speaker. In this hybrid system, the fixed filter in the speaker provides a good virtual height effect, and the calibration system in the AVR further refines this effect with more knowledge of the listening environment.

Figure 13:
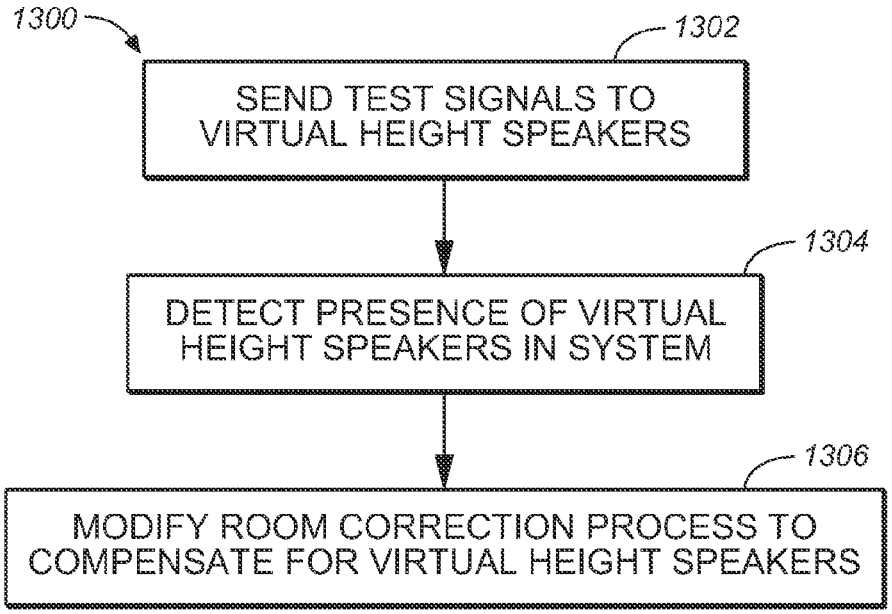
FIG. 13 is a flow diagram illustrating a method of performing virtual height filtering in an adaptive audio system, under an embodiment.

FIG. 13 is a flow diagram illustrating a method of performing virtual height filtering in an adaptive audio system, under an embodiment. The process of FIG. 13 illustrates the functions performed by the components shown in FIG. 11. Process 1300 starts by sending a test signal or signals to the virtual height speakers with built-in virtual height filtering, act 1302. The built-in virtual height filtering produces a frequency response curve, such as that shown in FIG. 7, which may be seen as an anomaly that would be corrected by any room correction processes. In act 1304, the system detects the presence of the virtual height speakers, so that any modification due to application of room correction methods may be corrected or compensated to allow the operation of the virtual height filtering of the virtual height speakers, act 1306.

As described above and illustrated in FIGS. 4A-B and 7, the virtual height filter may be implemented in a speaker either on its own or with or as part of a crossover circuit that separates input audio frequencies into high and low bands, or more depending on the crossover design. Either of these circuits may be implemented as a digital DSP circuit or other circuit that implements an FIR (finite impulse response) or IIR (infinite impulse response) filter to approximate the virtual height filter curve, such as shown in FIG. 3. Either of the crossover, separation circuit, and/or virtual height filter may be implemented as passive or active circuits, wherein an active circuit requires a separate power supply to function, and a passive circuit uses power provided by other system components or signals.

Figure 14A:
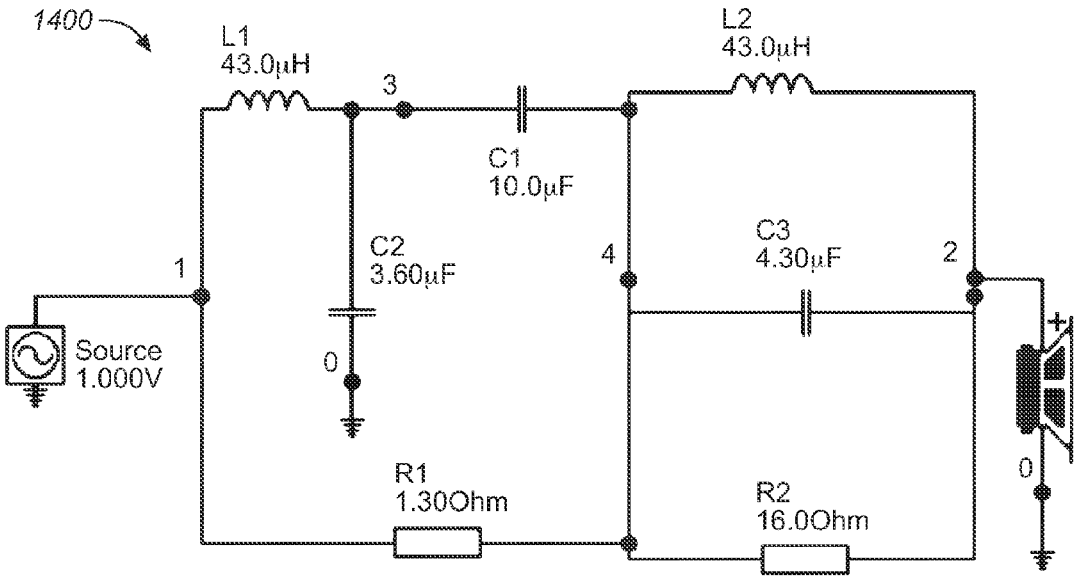
FIG. 14A is a circuit diagram illustrating an analog virtual height filter circuit, under an embodiment.
Figure 14B:
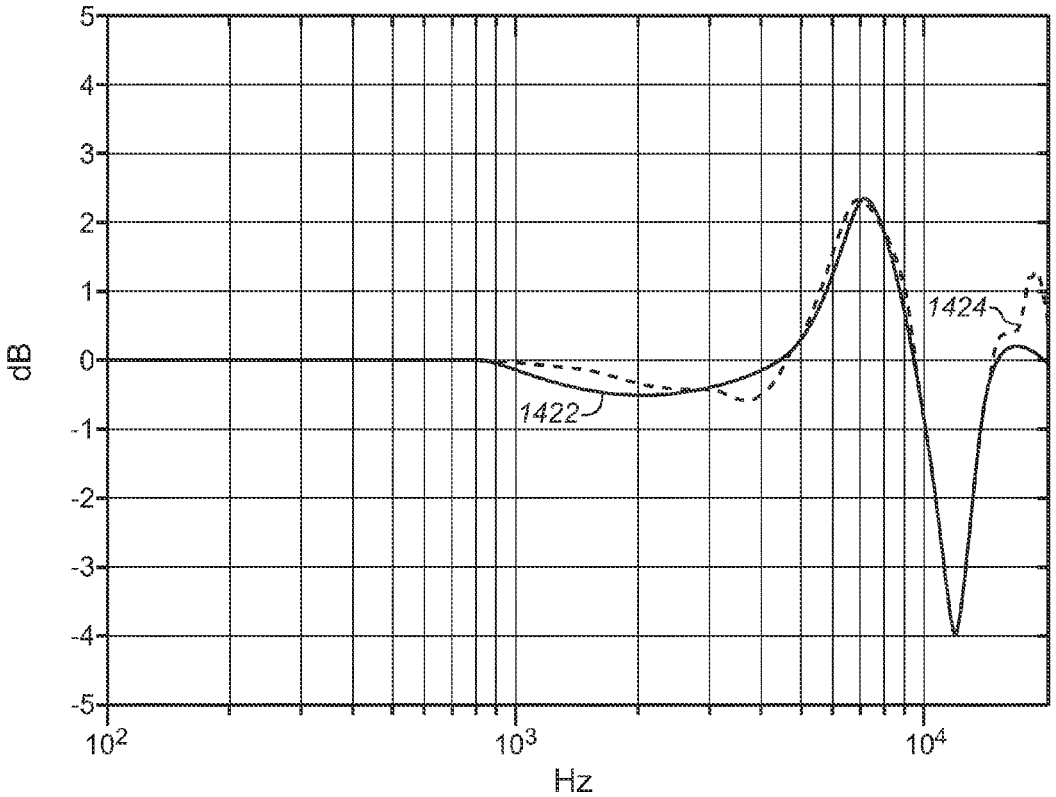
FIG. 14B illustrates an example frequency response curve of the circuit of FIG. 14A in conjunction with a desired response curve.

For an embodiment in which the height filter or crossover is provided as part of a speaker system (cabinet plus drivers), this component may be implemented in an analog circuit. FIG. 14A is a circuit diagram illustrating an analog virtual height filter circuit, under an embodiment. Circuit 1400 includes a virtual height filter comprising a connection of analog components with values chosen to approximate the equivalent of curve 302 with scaling parameter $\alpha$=0.5 for a 3-inch 6-ohm speaker with a nominally flat response to 18 kHz. The frequency response of this circuit is depicted in FIG. 14B as a black curve 1422 along with the desired curve 1424 in gray. The example circuit 1400 of FIG. 14 is meant to represent just one example of a possible circuit design or layout for a virtual height filter circuit, and other designs are possible.

Figures 15A, 15B:
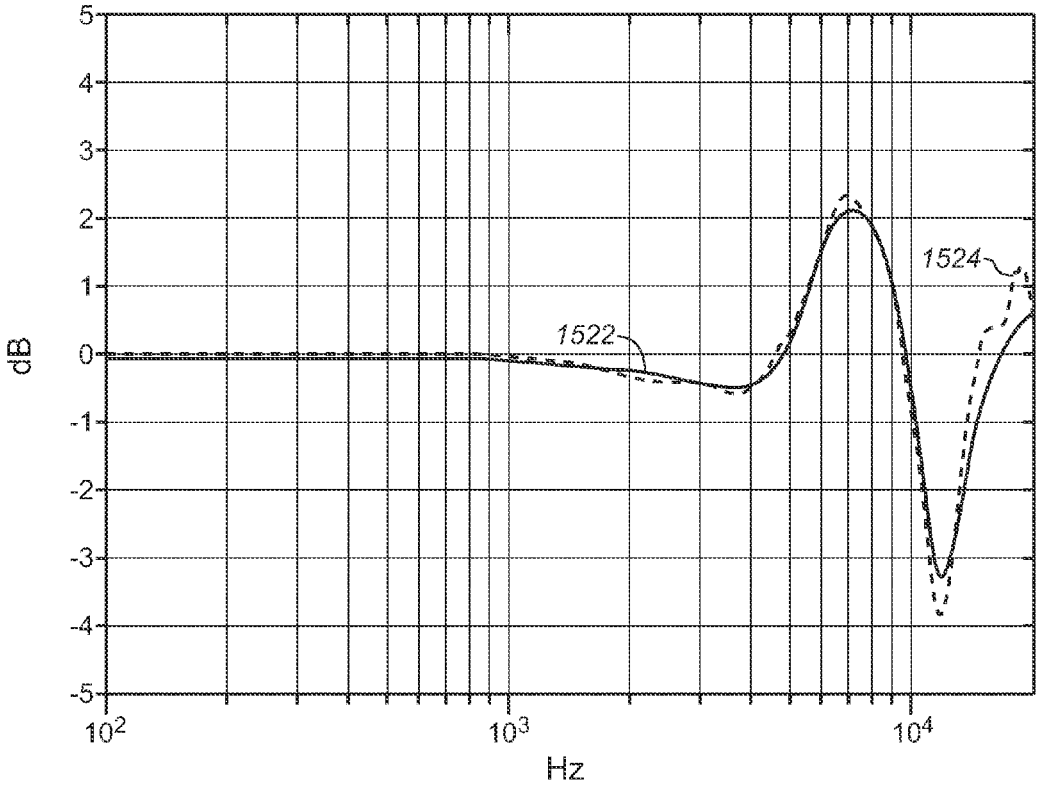
FIG. 15A illustrates example coefficient values for a digital implementation of a virtual height filter, under an embodiment.
FIG. 15B illustrates an example frequency response curve of the filter of FIG. 15A along with a desired response curve.

FIG. 15A depicts a digital implementation of the height cue filter for use in a powered speaker employing a DSP or active circuitry. The filter is implemented as a fourth order IIR filter with coefficients chosen for a sampling rate of 48 kHz. This filter may alternatively be converted into an equivalent active analog circuit through means well known to one skilled in the art. FIG. 15B depicts an example frequency response curve 1524 of this filter along with a desired response curve 1522.

Speaker Specifications

The speakers used in an adaptive audio system that implements virtual height filtering for a home theater or similar listening environment may use a configuration that is based on existing surround-sound configurations (e.g., 5.1, 7.1, 9.1, etc.). In this case, a number of drivers are provided and defined as per the known surround sound convention, with additional drivers and definitions provided for the upward-firing sound components.

Figure 16:
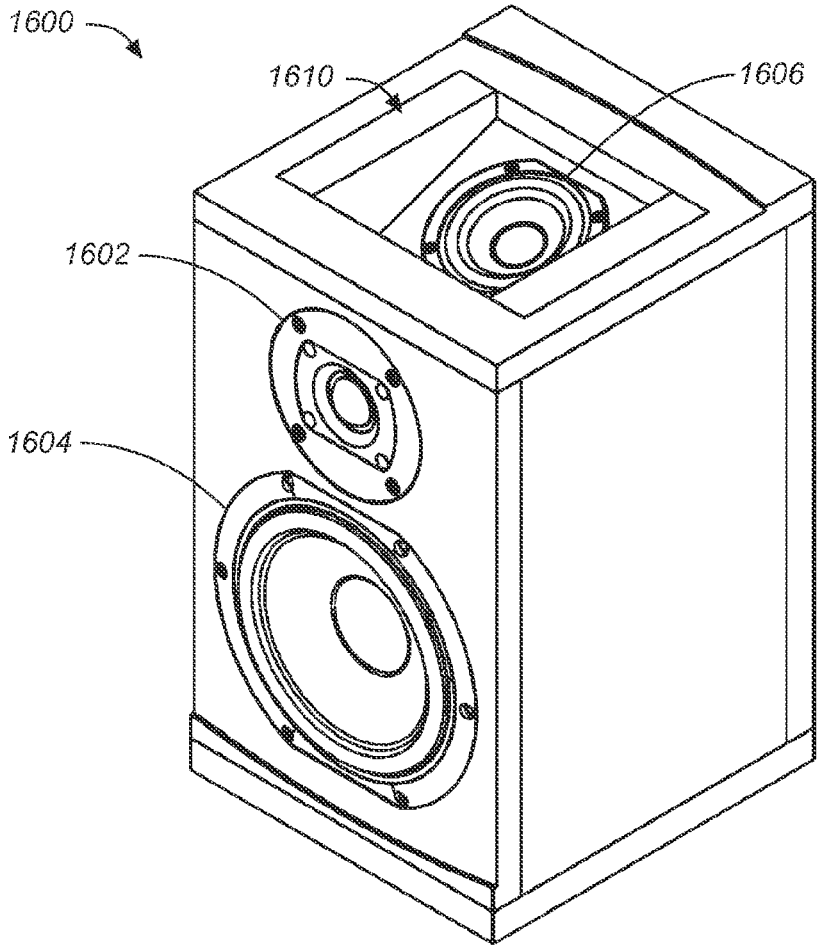
FIG. 16 illustrates a speaker integrating direct and upward firing drivers in an integrated cabinet, under an embodiment.

As shown in FIG. 10, upward firing and direct drivers may be packaged in various different configurations with different stand-alone driver units and combinations of drivers in unitary cabinets. FIG. 16 illustrates the configuration of upward and direct firing speakers for a reflected sound application that utilizes virtual height filtering, under an embodiment. In speaker system 1600 a cabinet contains direct firing drivers comprising woofer 1604 and tweeter 1602. An upward firing driver 1606 is disposed to transmit signals out of the top of the cabinet for reflection off of the ceiling of the listening room. As described earlier, the inclination angle may be set to any appropriate angle, such as 20 degrees, and the driver 1606 may be manually or automatically movable with respect to this inclination angle. Sound absorbing foam 1610, or any similar baffling material may be included in the upward firing driver port to acoustically isolate this driver from the rest of the speaker system. The configuration of FIG. 16 is intended to provide an example illustration only, and many other configurations are possible. The cabinet size, driver size, driver type, driver placement, and other speaker design characteristics may all be configured differently based on the requirements and limitations of the audio content, rendering system and listening environment.

Figure 17:
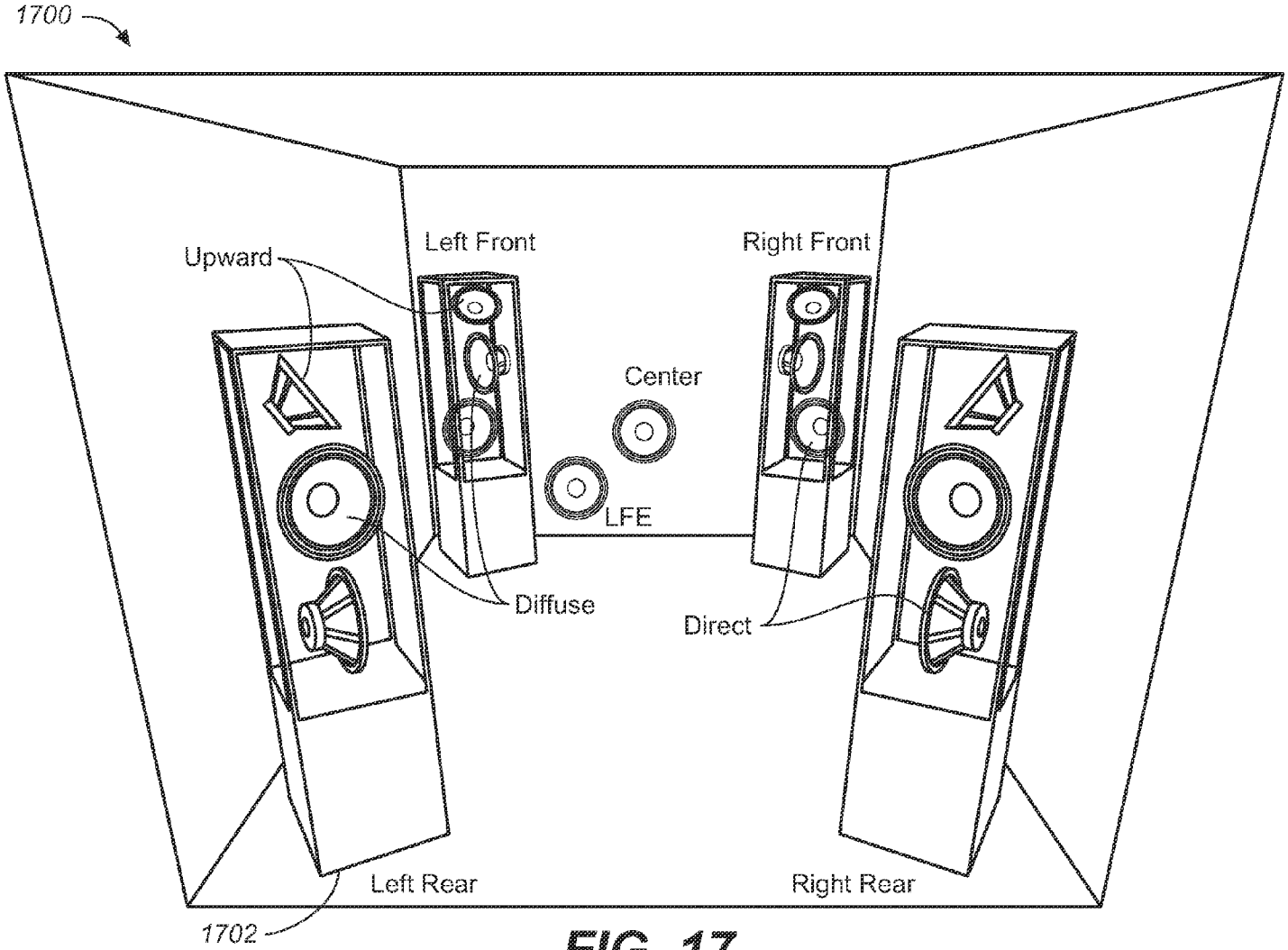
FIG. 17 illustrates an example placement of speakers having upward-firing drivers and virtual height filter components within a listening environment.

In a typical adaptive audio environment, a number of speaker enclosures will be contained within the listening environment. FIG. 17 illustrates an example placement of speakers having upward-firing drivers and virtual height filter components within a listening environment. As shown in FIG. 17, listening environment 1700 includes four individual speakers 1702, each having at least one front-firing, side-firing, and upward-firing driver. The listening environment may also contain fixed drivers used for surround-sound applications, such as center speaker and subwoofer or LFE (low-frequency element). As can be seen in FIG. 17, depending on the size of the listening environment and the respective speaker units, the proper placement of speakers 1702 within the listening environment can provide a rich audio environment resulting from the reflection of sounds off the ceiling from the number of upward-firing drivers. The speakers can be aimed to provide reflection off of one or more points on the ceiling plane depending on content, listening environment size, listener position, acoustic characteristics, and other relevant parameters.

As stated previously, the optimal angle for an upward firing speaker is the inclination angle of the virtual height driver that results in maximal reflected energy on the listener. In an embodiment, this angle is a function of distance from the speaker and ceiling height. While generally the ceiling height will be the same for all virtual height drivers in a particular room, the virtual height drivers may not be equidistant from the listener or listening position 106. The virtual height speakers may be used for different functions, such as direct projection and surround sound functions. In this case, different inclination angles for the upward firing drivers may be used. For example, the surround virtual height speakers may be set at a shallower or steeper angle as compared to the front virtual height drivers depending on the content and room conditions. Furthermore, different a scaling factors may be used for the different speakers, e.g., for the surround virtual height drivers versus the front height drivers. Likewise, a different shape magnitude response curve may be used for the virtual height model 302 that is applied to the different speakers. Thus, in a deployed system with multiple different virtual height speakers, the speakers may be oriented at different angles and/or the virtual height filters for these speakers may exhibit different filter curves.

Native Transducer Design

Figure 18:
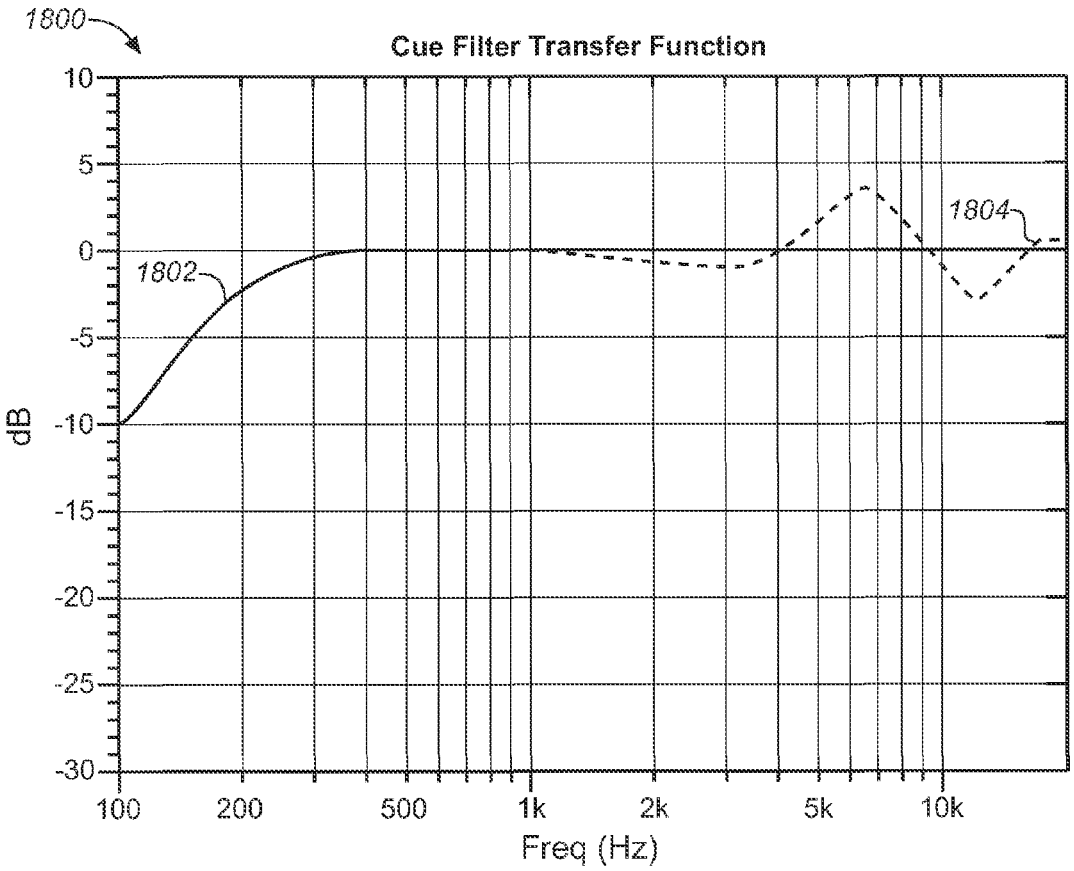
FIG. 18 illustrates a height cue filter transfer function for use in height-specific transducer designs, under an embodiment.

Embodiments have been described wherein the virtual height frequency curve for use with upward firing drivers is provided by a specific circuit or digital processing component. Such a circuit may add a certain amount of cost and complexity to an audio playback system, which may be undesirable. In an embodiment, the desired virtual height transfer function may be designed into the upward firing driver's native frequency response. Many speakers have inherent high frequency errors by parts that do not remain linear in the speakers operating range, and that may be similar to the desired height filter transfer function. In current driver designs, these errors are typically minimized to produce a more linear speaker. However, a specific non-linear response to improve height cue information may be designed directly into drivers intended to reflect sound off of ceiling surfaces. Certain characteristics and components of the drivers or transducers of the upward firing speaker may be modified to incorporate a specific height cue transfer curve, such as that shown in diagram 1800 of FIG. 18. FIG. 18 illustrates a desired height cue transfer curve 1804 compared to a linear curve 1802 of an optimum linearized driver. The curve 1804 may correspond to the virtual height filter curve 302, or it may be a modified curve optimized for the design of the upward firing driver or drivers.

Certain elements of the upward firing driver are modified to create the desired height transfer function 1804 natively in the driver itself, and may include the driver cone, dust cap, spider, or other elements.

In an embodiment, the driver cone and/or cone edge may be modified. A cone edge assembly with a thin band on the perimeter of the cone or multiple varying thickness bands may be used. The cone may alternatively include a hinged section or multiple hinged sections using 'u' or 'v' shaped areas on the cone. The driver may also utilize bands of the cone area that are not tangent to the main cone profile, i.e., zig-zag profiles; or a section of the outside cone perimeter that is at a very small angle to the front plane of the speaker producing a substantially flat area. Alternatively, a section of the inside edge perimeter that is at a very small angle to the front plane of the speaker may be used to create a substantially flat area that can radiate independent of the cone body. This may also be accomplished by a section of the inside edge perimeter that is at a very acute angle to the front plane of the speaker with a large increase in the moment arm mass at the junction of the cone/edge assembly. The cone may also incorporate a hinged section or multiple hinged sections using 'u' or 'v' shaped areas on the edge; or an edge with a substantially asymmetrical compliance between the forward and rear excursion that creates harmonics in the required band. These design variations are all meant to introduce harmonics that help create the desired response curve 1804 for the driver.

The driver cone is often capped with a dust cap positioned in the center of the cone circle. The dust cap may also be configured to help produce the desired frequency curve. For example, a cone dust cap assembly with a hinged cone section or thin cone sections that allow the dust cap to vibrate at high frequencies in a substantially decoupled mode may be used. Alternatively, the dust cap may be shaped to become an efficient secondary radiator at the desired height frequency range. Similarly, a dust cap with a cone shaped whizzer or other spinning or vibrating element that is shaped to become an efficient secondary radiator at the height frequency range may be used. Such a dust cap may be modified and used by itself, or in combination with modified cone assembly.

The cone is typically supported by a plastic or metal frame called a spider. In an embodiment, the spider may be modified instead of, or in conjunction with the cone and/or dust cap. For example, a spider with a substantially asymmetrical compliance between the forward and rear excursion that creates harmonics in the required band may be used.

Certain specifications may be defined to optimize the upward firing driver. For example, the specification may define a transducer incorporating a cone with a varying cross-section shape that creates a high frequency response with a rise at 7 kHz of 5 dB followed by a drop of 7 dB at 12 kHz, and such a varying cross-section shape may include an annular section creating a hinge that allows this section cone to vibrate anti-phase to the rest of the cone body. It should be noted that all of the cited modifications to the driver elements may be used alone or in combination with each other to produce the desired frequency response curve.

Instead of the cone portion of the driver, the desired frequency curve may be built into the speaker using other or additional speaker components. In an embodiment, a wave guide (e.g., horn, lens, etc.) is used independently or in conjunction with the upward firing driver to produce the target desired target function 1804. This embodiment uses a waveguide to create the desired transfer function by controlling directivity. For this embodiment, the desired transfer function itself is created by the waveguide shape, and/or the use of the waveguide in conjunction with the optimized driver creates the desired transfer function.

In general, the upward-firing speakers incorporating virtual height filtering techniques as described herein can be used to reflect sound off of a hard ceiling surface to simulate the presence of overhead/height speakers positioned in the ceiling. A compelling attribute of the adaptive audio content is that the spatially diverse audio is reproduced using an array of overhead speakers. As stated above, however, in many cases, installing overhead speakers is too expensive or impractical in a home environment. By simulating height speakers using normally positioned speakers in the horizontal plane, a compelling 3D experience can be created with easy to position speakers. In this case, the adaptive audio system is using the upward-firing/height simulating drivers in a new way in that audio objects and their spatial reproduction information are being used to create the audio being reproduced by the upward-firing drivers. The virtual height filtering components help reconcile or minimize the height cues that may be transmitted directly to the listener as compared to the reflected sound so that the perception of height is properly provided by the overhead reflected signals.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A speaker driver for rendering sound for reflection off of an upper surface of a listening environment, comprising:

a driver cone;

a cone dust cap affixed to a central portion of the driver cone; and a frame securing the cone for mounting within a speaker cabinet, wherein at least one of the driver cone, dust cap, and frame are configured to apply a height filter having a frequency response curve that is configured to at least partially remove directional cues from a speaker location, and at least partially insert the directional cues from a reflected speaker location, the frequency response curve based on a first frequency response of a filter modeling sound travelling directly from the reflected speaker location to the ears of a listener at a listening position, for said inserting of directional cues from the reflected speaker location, and a second filter frequency response of a filter modeling sound travelling directly from the speaker location to the ears of the listener at the listening position, for removing of directional cues for audio travelling along a path directly from the speaker location to the listener.

2. The speaker driver of claim 1, wherein the height filter is applied to one or more audio signals comprising height sound components transmitted to the speaker driver, and further wherein the frequency response curve is a universal height filter frequency response curve that represents an average of a plurality of individual height filter frequency responses, where each of the individual height filter frequency responses corresponds to a different combination of reflected speaker location, listening position, and physical speaker location.

3. The speaker driver of claim 1, wherein the height filter response exhibits a peak located at about 7 kHz and a notch at about 12 kHz.

4. A system for rendering sound using reflected sound elements, comprising:

a speaker placed at a speaker location and comprising a housing enclosing an upward-firing driver oriented at an inclination angle relative to the ground plane and configured to reflect sound off an upper surface of a listening environment to produce a reflected speaker location; and a virtual height filter applying a frequency response curve to an audio signal transmitted to the upward-firing driver, wherein the virtual height filter at least partially removes directional cues from the speaker location and at least partially inserts the directional cues from the reflected speaker location, the frequency response curve based on a first frequency response of a filter modeling sound travelling directly from the reflected speaker location to the ears of a listener at a listening position, for said inserting of directional cues from the reflected speaker location, and a second filter frequency response of a filter modeling sound travelling directly from the speaker location to the ears of the listener at the listening position, for removing of directional cues for audio travelling along a path directly from the speaker location to the listener.

5. The system of claim 4, wherein the audio signal comprises height sound components, and further wherein the frequency response curve is a universal height filter frequency response curve that represents an average of a plurality of individual height filter frequency responses, where each of the individual height filter frequency responses corresponds to a different combination of reflected speaker location, listening position, and physical speaker location.

6. The system of claim 4, wherein the height filter response exhibits a peak located at about 7 kHz and a notch at about 12 kHz.

7. The system of claim 4 wherein the inclination angle is variable, the system further comprising:

a location component configured to determine an optimum listening position within the listening environment; and a control component configured to alter the inclination angle to reflect the sound waves off of the upper surface to the optimum listening position.

8. The system of claim 4 further comprising a detection component configured to detect the presence of the virtual height filter in the listening environment.

9. The system of claim 4 further comprising a bypass switch to bypass the virtual height filter during a calibration process that prepares audio playback equipment to transmit the sound waves to the listening environment.

10. The system of claim 4 further comprising a room correction component performing a pre-emphasis filtering operation on the sound waves transmitted to the listening environment to compensate for the virtual height filtering applied to the signal transmitted to the upward-firing driver.

11. The system of claim 4 further comprising a room correction component generating a target response of the listening environment by use of a probe signal and adding a default virtual height filter response to a target response of the listening environment.

12. The system of claim 4 wherein the virtual height filter implements an algorithm using a scaling factor to compensate for height cues present in sound waves transmitted directly through the listening environment in favor of the height cues present in the sound reflected off the upper surface of the listening environment.

13. The system of claim 4 wherein the virtual height filter represents a unique frequency response curve, and wherein one or more characteristics of the frequency response curve are changed based on the value of the inclination angle.

14. The system of claim 4, wherein the housing further encloses a front-firing driver configured to transmit sound waves along an axis proximately corresponding to the ground plane.

15. The system of claim 14, wherein the speaker comprises two input terminals, wherein the first input terminal is configured to receive signals corresponding to the sound to be reflected off the upper surface of the listening environment, and the second input terminal is configured to receive signals corresponding to the sound waves to be transmitted along the axis proximately corresponding to the ground plane.

16. The system of claim 14, wherein the system further comprises a crossover filter, the crossover filter having a low-pass section configured to transmit low frequency signals below a threshold frequency to the front-firing driver, and a high-pass section configured to transmit high frequency signals above the threshold frequency to the upward-firing driver.

17. A speaker for transmitting sound waves to be reflected off an upper surface of a listening environment, comprising:

a housing;

an upward-firing driver within the housing and oriented at an inclination angle relative to a ground plane and configured to reflect sound off a reflection point on the upper surface of the listening environment; and a virtual height filter applying a frequency response curve to a signal transmitted to the upward-firing driver, the frequency response curve based on a first frequency response of a filter modeling sound travelling directly from a reflected speaker location to the ears of a listener at a listening position, for inserting of directional cues from the reflected speaker location, and a second filter frequency response of a filter modeling sound travelling directly from a speaker location to the ears of the listener at the listening position, for removing of directional cues for audio travelling along a path directly from a speaker location to the listener.

18. The speaker of claim 17, wherein the signal comprises height sound components, and further wherein the frequency response curve is a universal height filter frequency response curve that represents an average of a plurality of individual height filter frequency responses, where each of the individual height filter frequency responses corresponds to a different combination of reflected speaker location, listening position, and physical speaker location.

19. The speaker of claim 17, wherein the height filter response exhibits a peak located at about 7 kHz and a notch at about 12 kHz.

20. The speaker of claim 17, further comprising a physical interface allowing the housing to be installed on a front-firing driver cabinet that is configured to transmit sound waves along an axis proximately corresponding to the ground plane.

* * * * *